US011708841B2

(12) United States Patent
Johnson et al.

(10) Patent No.: US 11,708,841 B2
(45) Date of Patent: Jul. 25, 2023

(54) ADAPTIVE VOLUTES FOR CENTRIFUGAL PUMPS

(71) Applicant: Massachusetts Institute of Technology, Cambridge, MA (US)

(72) Inventors: Hilary A. Johnson, Portland, OR (US); Alexander H. Slocum, Bow, NH (US); Kevin P. Simon, Somerville, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 17/026,124

(22) Filed: Sep. 18, 2020

(65) Prior Publication Data

US 2021/0079928 A1 Mar. 18, 2021

Related U.S. Application Data

(60) Provisional application No. 62/902,027, filed on Sep. 18, 2019.

(51) Int. Cl.
*F04D 29/46* (2006.01)
*F04D 15/00* (2006.01)
(Continued)

(52) U.S. Cl.
CPC ..... *F04D 29/426* (2013.01); *F04D 15/0027* (2013.01); *F04D 29/445* (2013.01); *F04D 29/468* (2013.01); *F05D 2250/52* (2013.01)

(58) Field of Classification Search
CPC ..... F04D 29/2255; F04D 29/622; F04D 29/4286; F04D 29/46; F04D 29/464;
(Continued)

(56) References Cited

U.S. PATENT DOCUMENTS 3,150,650 A 9/1964 Glene et al.
3,365,120 A * 1/1968 Jassniker ..... F01D 17/143 415/126
(Continued)

FOREIGN PATENT DOCUMENTS

DE 4200507 A1 * 7/1993 ..... F01D 17/143
EP 2626573 A1 8/2013
GB 2049832 A * 12/1980 ..... F01D 5/048

OTHER PUBLICATIONS

Sandler, "Experimental Determination of Volute Effects on the Stability of Low Specific Speed Centrifugal Pumps," Massachusetts Institute of Technology, 1992.
(Continued)

*Primary Examiner* — Justin D Seabe
(74) *Attorney, Agent, or Firm* — Barnes & Thornburg, LLP

(57) ABSTRACT

Centrifugal pump systems and related methods are disclosed herein that can shift a best efficiency point of a pump based on one or more operating conditions to operate more efficiently across and/or adjust to a broader range of conditions. Pumps provided for herein can include an adaptive volute in which a geometry of the volute can be adjusted to shift an operating efficiency of the pump. In some embodiments, a height or radial dimension of the adaptive volute can be adjusted based on one or more operating condition. A geometry of the adaptive volute can be adjusted during operation of the pump and/or while an impeller is disposed within the volute. In some embodiments, a first and second collar can be disposed within the adaptive volute. Rotation of the first component can move the second component axially, which can expand or contract an axial dimension of the adaptive volute.

25 Claims, 12 Drawing Sheets

(51) Int. Cl.
*F04D 29/42* (2006.01)
*F04D 29/44* (2006.01)

(58) Field of Classification Search
CPC .. F04D 29/468; F04D 29/445; F04D 15/0038; F04D 15/0027
See application file for complete search history.

(56) References Cited

U.S. PATENT DOCUMENTS

| | | | | |
|---|---|---|---|---|
| 3,551,072 | A | 12/1970 | Zimmerly | |
| 3,784,318 | A | 1/1974 | Davis | |
| 3,941,498 | A | 3/1976 | Duckworth et al. | |
| 4,219,305 | A * | 8/1980 | Mount | F01D 17/143 415/48 |
| 4,378,194 | A * | 3/1983 | Bandukwalla | F01D 17/143 415/49 |
| 4,381,171 | A * | 4/1983 | Chapple | F01D 17/143 415/157 |
| 4,544,325 | A * | 10/1985 | Rogo | F01D 17/143 415/150 |
| 4,643,639 | A | 2/1987 | Caine | |
| 4,932,835 | A * | 6/1990 | Sorokes | F04D 29/462 415/150 |
| 5,127,800 | A | 7/1992 | Hyll et al. | |
| 5,211,530 | A | 5/1993 | Shiffler | |
| 6,431,823 | B1 * | 8/2002 | Slepoy | F04D 15/0027 415/126 |
| 9,759,224 | B2 * | 9/2017 | Burgess | B66C 1/44 |
| 9,777,578 | B2 | 10/2017 | Yokoyama et al. | |
| 9,822,784 | B2 | 11/2017 | Aiba et al. | |
| 10,082,147 | B2 * | 9/2018 | Jiang | F04D 17/10 |
| 2003/0026692 | A1 | 2/2003 | Lutz | |
| 2011/0081255 | A1 | 4/2011 | Steger et al. | |
| 2013/0064682 | A1 * | 3/2013 | Sun | F04D 29/464 417/18 |
| 2013/0219885 | A1 | 8/2013 | Watson et al. | |
| 2013/0287558 | A1 * | 10/2013 | Buse | F04D 5/002 415/203 |
| 2016/0238012 | A1 * | 8/2016 | Nejedly | F02C 7/042 |
| 2016/0305447 | A1 | 10/2016 | Dreiss et al. | |
| 2017/0328247 | A1 | 11/2017 | Calkin et al. | |
| 2017/0356301 | A1 | 12/2017 | Florindo | |

OTHER PUBLICATIONS

Sayma, "Computational Fluid Dynamics," Ventus Publishing ApS, 2019.
Sideris et al., "Flow in Centrifugal Compressors," 1987.
Slocum, "Precision Machine Design," Section 2, Prentice Hall. 1994.
Slocum, "Precision Machine Design," Section 7-7, Prentice Hall. 1992.
Stan et al., "Centrifugal Pump Monitoring and Determination of Pump Characteristics Curves Using Experimental and Analytical Solutions," Processes, 2018.
Stepanoff, "Centrifugal and Axial Flow Pumps: Theory, Design, and Application," 1948.
Tan et al., "Influence of Volute Basic Circle Diameter on the Pressure Fluctuations and Flow Noise of a Low Specific Speed Sewage Pump," J. Vibroengineering, 19(5), 2017, pp. 3779-3796.
U.S. Department of Energy, "Energy Conservation Program: Energy Conservation Standards for Pumps."
U.S. Department of Energy, "Improving Pumping System Performance: A Sourcebook for Industry," May 2006.
Vagramenko, "Application of the Reichardt Model in Problems of Turbulence Near the Wall," Fluid Dynamics, 7, pp. 203-211, 1972.
Veres, "Centrifugal and Axial Pump Design and Off-Design Performance Prediction," NASA Technical Memorandum 106745, p. 24, 1994.
Vogelesang, "An Introduction to Energy Consumption in Pumps," World Pumps, 2008(496), pp. 28-31, 2008.
Weidong et al., "The Influence of Impeller Eccentricity on Centrifugal Pump," Advances in Mechanical Engineering, 9 (9), pp. 1-17, 2017.
Worster et al., "The Flow in Volutes and Its Effect on Centrifugal Pump Performance," Proc. Inst. Mech. Eng., 177(1), pp. 843-875, 1963.
Yang et al., "Research on Pump Volute Design Method Using CFD," Int. J. Rotating Mach., pp. 1-7, 2011.
Yannopoulos et al., "Evolution of Water Lifting Devices (Pumps) Over the Centuries Worldwide," Water, 2015.
Young et al., "Modeling the Air-Cooled Gas Turbine: Part 1—General Thermodynamics," ASME, 124, 2002.
Young et al., "Modeling the Air-Cooled Gas Turbine: Part 2—Coolant Flows and Losses," ASME, 124, 2002.
Zhang et al., "Modelign and Optimization of a Wasterwater Pumping System with Data-Mining Methods," Applied Energy, 164, 2016.
Afzal, "Asymptotic Analysis of Turbulent Couette Flow," Fluid Dynamics Research, 12, pp. 163-171, 1993.
Alemi et al., "Effects of Volute Curvature on Performance of a Low Specific-Speed Centrifugal Pump at Design and Off-Design Conditions," J. Turbomach., 137(4), 2015, pp. 041009.
Alvarado et al., "Nonlinear Flow Response of Soft Hair Beds," Nat. Phys., 13(10), 2017, pp. 1014-1019.
Ansys, "Fluent Getting Started Guide," Jan. 2017.
Arun Shankar et al., "A Comprehensive Review on Energy Efficiency Enhancement Initiatives in Centrifugal Pumping System," Applied Energy, 181, 2016, pp. 495-513.
Augustyn, "Energy Efficiency and Savings in Pumping Systems—The Holistic Approach," Southern African Energy Efficiency Convention, 2012.
Ayder et al., "Experimental and Theoretical Analysis of the Flow in a Centrifugal Compressor Volute." American Society of Mechanical Engineers, 1992.
Bach et al., "A Review of Selected Pumping Systems in Nature and Engineering-Potential Biomimetic Concepts for Improving Displacement Pumps and Pulsation Damping," Bioinspiration & Biomimetics, 10, 2015.
Baldwin et al., "Thin Layer Approximation and Algebraic Model for Separated Turbulent Flows," AIAA 16th Aerospace Sciences Meeting, 1978.
Baun et al., "Effects of Volute Design and Number of Impeller Blades on Lateral Impeller Forces and Hydraulic Performance," Int J. Rotating Mach. 9(2), pp. 145-152, 2003.
Bowerman et al., "Effect of the Volute on Performance of a Centrifugal-Pump Impeller," ASME, Jul. 1957.
Bloch et al., "Pump User's Handbook: Life Extension," CRC Press. 2004. Parts 1-3.
Bradshaw et al., "Calculation of Boundary-Layer Development Using the Turbulent Energy Equation: Compressible Flow on Adiabatic Walls," J. Fluid Mech., 46(1), pp. 83-110, 1971.
Brennen, "Hydrodynamics of Pumps," Oxford University Press, 1994.
Brogan et al., "Improving Variable-Speed Pumping Control to Maximize Savings," ASHRAE Transactions, 122(2), 2016.
Chouchane et al., "Design and Modeling of Mechanical Systems—II," Proceedings of the Sixth Conference on Design and Modeling of Mechanical Systems, 2015.
Csanady, "Radial Forces in a Pump Impeller Caused by a Volute Casing" Transaction of the ASME, Oct. 1962.
Dahl, "The Theory and Application of True Weighted Efficiency—A New Metric to Evaluate Pump Energy Efficiency Considering Multiple Operating Conditions," Turbomachinery Laboratory, Texas A&M Engineering Experiment Station, 2018.
Daw et al. "Energy Efficiency Strategies for Municipal Wastewater Treatment Facilities," Technical Report, National Renewable Energy Laboratory, 2012.
Dawson, "A Key Variable in Predicting and Extending Bearing Life," Isomag Corporation, 2019.
De Langre et al., "On the Scaling of Drag Reduction by Reconfiguration in Plants," Comptes Rendus Mecanique, 2012.

(56) References Cited

OTHER PUBLICATIONS

Denton, "Loss Mechanisms in Turbomachines," IGTI Scholar Lecture, 1993.
Dharmarathne et al., "On the large- and small-scale motions in a separated, turbulent-boundary-layer flow," Journal of Turbulence, 20(9), 2019.
Duest, "Deer Island Treatment Plant," Massachusetts Water Resources Authority, 2017.
El-Naggar, "A One-Dimensional Flow Analysis for the Prediction of Centrifugal Pump Peformance Characteristics," International Journal of Rotating Machinery, 2013.
Feneley et al., "Variable Geometry Turbocharger Technologies for Exhaust Energy Recovery and Booting—A Review," Renewable and Sustainable Energy Reviews, 71, pp. 959-975, 2017.
Goulds Water Technology, "B36/3742 R4 Technical Brochure," 2017.
Greene, "Pumping Machinery: A Treatise on the History, Design, Construction and Operation of Various Forms of Pumps," J. Wiley & Sons, 1911.
Greitzer et al., "Internal Flow: Concepts and Applications," Cambridge University Press, Cambridge, 2004.
Gretler et al., "Calculation of Plane Turbulent Coutte-Poisueille Flows with a Modified k-e Model," Fluid Dynamics Research, 21, pp. 263-283, 1997.
Gulich, "Centrifugal Pumps," Springer, Berlin; New York, 2008.
Hunter, "Asymptotic Analysis and Singular Perturbation Theory," Department of Mathematics, University of California at Davis, Feb. 2004.
Hydraulic Institute, Europump, and U.S. Department of Energy, "Pump Life Cycle Costs," 2001.
Hydraulic Institute, Europump, and U.S. Department of Energy, "Variable Speed Pumping: A Guide to Successful Applications," Elsevier Science, Kidlington, Oxford, UK; New York, 2004.
Hydraulic Plant and Machinery Group, and Worster, R. C., "The Flow in Volutes and Its Effect on Centrifugal Pump Performance," Proc. Inst. Mech. Eng., 177(1), pp. 843-875, 1963.
International Search Report and Written Opinion for Application No. PCT/US20/51668, dated Dec. 15, 2020 (11 Pages).
Iversen et al., "Volute Pressure Distribution, Radial Force on the Impeller, and Volute Mixing Losses of a Radial Flow Centrifugal Pump," J. Eng. Power, 82(2), pp. 136-143, 1960.
Jin et al., "A Study on the Effect of Variation of the Cross-Sectional Area of Spiral Volute Casing for Centrifugal Pump," International Journal of Mechanical and Mechatronics Engineering, 6(8), p. 10, 2012.
Johnston, "Internal Flows," Turbulence, Springer-Verlag, 1978.
Johnston, "Radial-Flow Turbomachinery," Stanford University.
Kalaiselvan et al., "A Comprehensive Review on Energy Efficiency Enhancement Initiatives in Centrifugal Pumping System," Applied Energy, 181, pp. 495-513, 2016.
Karassik et al., "Pump Handbook," McGraw-Hill, New York, 3rd Edition, 2001. Parts 1-16.
Kelder et al., "Experimental and Theoretical Study of the Ow in the Volute of a Low Specific-Speed Pump," Fluid Dyn. Res., p. 14, 2001.
Lobanoff et al., "Centrifugal Pumps: Design & Application," 2nd Edition, Gulf Pub. Co. in association with Plant Engineering, Houston, 1992.
Lorett et al., "Interaction Between Impeller and Volute of Pumps at Off-Design Conditions," J. Fluids Eng., 108(1), p. 12, 1986.
Michiyoshi et al., "Fully Developed Turbulent Flow in a Concentric Annulus11" Journal of Nuclear Science and Technology, 5(7), pp. 354-359, Jul. 1968.
Minemura et al., "Prediction of Air-Water Two-Phase Flow Performance of a Centrifugal Pump Based on One-Dimensional Two-Fluid Model," Transaction of the ASME, 120, Jun. 1998.
Panton, "Incompressible Flow," John Wiley & Sons, Inc., 4th edition, Section 8, 2013.
Pedersen et al., "Flow and Pressure Control of Underbalanced Drilling Operations Using NMPC," J. Process Control, 68, pp. 73-85, 2018.
Reeves et al., "Study on Improving the Energy Efficiency of Pumps," European Commission, Feb. 2001.
Busemann, A., 1928, "The Delivery Head of Radial Centrifugal Pumps with Logarithmic Spiral Blades," Math Mech, 8 (5), p. 372.
Elger, D. F., LeBret, B. A., Crowe, C. T., and Roberson, J. A., 2016, Engineering Fluid Mechanics, John Wiley & Sons, Singapore.
Tuzson, J., 2000, Centrifugal Pump Design, John Wiley & Sons, New York.

* cited by examiner

ADAPTIVE VOLUTES FOR CENTRIFUGAL PUMPS

CROSS REFERENCE TO RELATED APPLICATION

This application claims priority to and the benefit of U.S. Provisional Application No. 62/902,027, filed Sep. 18, 2019, and titled "Adaptive Volutes for Centrifugal Pumps," the entirety of which is hereby incorporated by reference.

FIELD

The present disclosure relates to the use of adaptive structures of a centrifugal pump to improve the lifetime efficiency of the pump, e.g., by maintaining a higher efficiency at a wider range of operating points, and more particularly relates to changing geometries of an adaptive volute to achieve the same. The present disclosure further relates to centrifugal pumps with improved reliability, increased pump lifetime, and expanded range of operating conditions.

BACKGROUND

Centrifugal pumps are turbomachines that do work on a fluid to increase the energy of the flow. Work is done on the fluid by a rotating impeller that accelerates the flow. Flow exits the impeller into a spiral volute, which collects the flow and diffuses it, converting dynamic pressure into static pressure rise. Pumps, particularly centrifugal pumps, are ubiquitous: transporting fresh and wastewater, pumped hydro energy storage, building HVAC systems, petroleum extraction, mining, and crop irrigation, to name a just a few applications. Pumps move fluids through industrial and municipal systems. Globally, pumps use hundreds of terawatt hours of electricity per year. Studies on improving pump efficiency identify that better control and adaptability of pumps would enable improved lifetime pump efficiency. Lifecycle cost assessments of centrifugal pumps show about 40% of the total cost of a pump is spent on energy, compared to only 10% spent on the upfront capital purchase of the pump. Pumps that can vary their operation to meet demand can also provide cost savings by improving reliability and reducing expenses from maintenance, operation, and downtime.

Presently, centrifugal pumps are designed for most efficient operation at a single fluid flow and pressure. This best efficiency point, BEP, occurs when a tangential velocity of fluid from the impeller is equal to a tangential velocity of the fluid in the volute. This results in uniform static pressure distribution around the impeller outlet. The BEP for a particular pump occurs at the intersection of the impeller and volute characteristics for that particular pump. The operating point for a pump occurs at the intersection of the pump characteristic and the system characteristic. As pump system characteristics change, e.g., due to changes in fluid flow, pump stagnation pressure rise, etc., the operating point of the pump can move away from the BEP of that pump. This can cause both meridional velocity and static pressure to vary around the circumference of the volute. Flows greater than the BEP flow can lead to a flow acceleration in the volute, while flows lower than the BEP flow can lead to flow deceleration. Accordingly, pumps that operate in a system with fluctuating conditions sacrifice efficiency across the range of operating conditions. Additionally, meridionally varying static pressure will increase radial loads on the impeller and shaft, thereby decreasing the lifetime of the pump. Moreover, and as noted above, energy losses can be a significant driver in the cost of operating a pump.

There are currently at least three known approaches that can be used to match the BEP of a pump to a need of a system. First, selection of a pump can be tailored to match estimated operational conditions of the intended pump system. An engineer can define a system curve, i.e., expected flow and pressure, and, ideally, then select a pump such that the system curve intersects the pump curve at the BEP. In practice, however, a factor of safety is often added to the system curve estimation to ensure that the pump will be able to meet maximum flow and pressure requirements. This can result in selection of a pump that is larger than necessary, which can cause energy losses and reduce efficiency of the pump. More generally, operation of the pump can move away from the BEP if system operation diverges from the estimated operational conditions. Real systems often require operation over a range of pressures and flows, thereby shifting the system curve and operating efficiency of the pump.

Other known methods include adjusting the impeller. For example, a second approach is a variable speed drive, which can be implemented to adjust the speed of an impeller of a pump. Variable speed drives are mechanically complex in view of the need to place an adaptive mechanism on a rapidly rotating component. While such an adjustment can shift a pump operating curve, adjusting impeller speed can have significant impact on fluid flow and pressure output. For example, variable speed drives can suffer from a failure to maintain higher pressure at lower fluid flows. Further, an operator is often constrained to run a pump with a variable speed drive at the speed necessary to meet operational needs, which may not be the most efficient speed for the pump. The third known approach is impeller trimming, in which the impeller diameter is machined to a smaller diameter to cause a permanent shift in the pump curve. Adjusting impeller characteristics can have a significant impact on both the pump characteristic and a location of the BEP, which can make accurate and precise control difficult.

Notably, none of these approaches provide for a mechanism to maintain BEP operation of a uniform static pressure distribution around an impeller of a pump. Accordingly, there is a need for methods and devices to improve pump efficiency across a range of operating conditions.

SUMMARY

Centrifugal pump systems and related methods are disclosed herein that can shift a best efficiency point (BEP) of a pump based on one or more operating conditions such that the pump can operate more efficiently across a range of operating conditions. More particularly, the pumps provided for herein can include an adaptive volute such that a geometry of the volute can be adjusted while an impeller is disposed within the volute. Adjusting the geometry of the volute can include adjusting one or more of the length, width, height, volume, and/or surface area of the volute, and/or portions of the volute (e.g., a particular side(s) of the volute, a throat, a tongue, etc.). The adaptive volute geometry can be adjusted based on one or more operating conditions or parameters such as a volumetric flow rate, pressure rise between an inlet and an outlet of the pump, circumferential static pressure distribution around the volute, a desired fluid flow rate for fluid discharged from the volute, a desired fluid volume for the fluid discharged from the volute, a pressure of the fluid received via the inlet of the pump, a desired pressure output of the pump, a measured wire-to-water efficiency of the pump, motor current, motor voltage, shaft torque, and/or shaft speed. In this manner, the volute geometry can be adjusted during operation of the pump to meet variable system demand, which can maintain the uniform static pressure condition of the pump across varying operating conditions. In some embodiments, the pump can continuously vary the volute geometry to maintain optimal efficiency during operation. Accordingly, pumps of the present disclosure can operate at or near the BEP over a wide range of system characteristics, which can improve overall efficiency of the pump and reduce operational costs.

One exemplary embodiment of a centrifugal pump in accordance with the present disclosure includes an impeller and a volute in which the impeller is disposed. The volute has an inlet for receiving fluid from an outside environment and an outlet for discharging fluid impelled by the impeller, out of the volute. The volute includes a first collar and a second collar disposed within a casing. The first collar and the second collar are configured such that the second collar moves axially in response to rotation of the first collar, thereby changing a cross-sectional area of the volute to adjust a flow of the fluid impelled by the impeller and out of the volute.

In some embodiments of the pump, the first collar can be an outer collar and the second collar can be an inner collar. The outer collar and the inner collar can be threadably engaged such that rotation of the outer collar can cause the inner collar to move axially within the casing. A distal end of the inner collar can include a plunger that can define an axial dimension of the volute. In other embodiments of the pump, the first collar can be a top wedge and the second collar can be a bottom wedge. The bottom wedge can translate axially in response to rotation of the top wedge. The top wedge can have a sliding engagement feature on a bottom side thereof and the bottom wedge can have a sliding engagement feature on a top side thereof, with the sliding engagement feature of the top wedge configured to engage the sliding engagement feature of the bottom wedge to cause the bottom wedge to translate in response to rotation of the top wedge. In some embodiments, the sliding engagement feature of the top wedge can be a plurality of saw-tooth extensions and the sliding engagement feature of the bottom wedge can be a plurality of saw-tooth extensions configured to slide along the plurality of saw-tooth extensions of the top wedge. The bottom wedge can be rotationally constrained.

The first collar can be configured to rotate about a longitudinal axis of the pump, the longitudinal axis of the pump extending substantially centrally through the inlet of the volute and an impeller shaft of the impeller. The second collar can be configured to translate axially along the longitudinal axis of the pump. In some embodiments, the first collar can have a shape defined by an inner circumference and an outer circumference. The shape of the first collar can be substantially concentric with a shape of the impeller. The second collar can have a shape defined by an inner circumference and an outer circumference, in which the inner circumference of the second collar can be substantially concentric with the shape of the impeller and the outer circumference of the second collar can have a shape that is commensurate with a shape of an inner wall of the volute. The outer circumference of the second collar can be a logarithmic spiral that can substantially match an expanding shape of the inner wall of the volute. In some embodiments, the volute can be a spiral volute.

In some embodiments, the first collar can include geared teeth on at least a portion of an outer surface. The first collar can be configured to be driven by a worm drive. The second collar can be adjustable such that it can be selectively moved with respect to the casing of the volute to change the cross-sectional area of the volute. The pump can further include a controller that can be configured to command selective movement of the first collar based on one or more parameters. The one or more parameters can include at least one of a desired fluid flow rate for the fluid discharged from the volute, a desired fluid volume for the fluid discharged from the volute, a pressure of the fluid received via the inlet, a pressure change between the inlet and the outlet of the pump, a meridional distribution of static pressure in the volute, power consumed by the pump, a pump motor voltage, a pump motor current, impeller shaft torque, or impeller shaft speed. In some embodiments, a rotational speed of the impeller can be variable.

Another exemplary embodiment of a centrifugal pump in accordance with the present disclosure includes an impeller and an adaptive volute in which the impeller is disposed. The adaptive volute has an inlet for receiving fluid from an outside environment and an outlet for discharging out of the adaptive volute fluid impelled by the impeller. The adaptive volute is configured to adjust its available volume in it in response to one or more parameters of the fluid received via the inlet.

The adaptive volute can include an axial adjustment mechanism that can be configured to adjust an axial height of the adaptive volute, in which the axial height of the adaptive volute is measured along a longitudinal axis of the pump that extends substantially centrally through the adaptive volute inlet. In some embodiments, the adaptive volute can include a radial adjustment mechanism that can be configured to adjust a radial dimension of the volute, thereby changing a cross-sectional area of the volute to adjust a flow of the fluid accelerated by the impeller and out of the volute. In some such embodiments, the radial adjustment mechanism can include a curved wedge.

The adaptive volute can include a tapered component. In some embodiments, the adaptive volute can be flexible. The adaptive volute can be a spiral adaptive volute. The pump can further include a controller that can be configured to command adjustment of the available volume of the adaptive volute in response to one or more parameters. The one or more parameters can include at least one of a desired fluid flow rate for the fluid discharged from the adaptive volute, a desired fluid volume for the fluid discharged from the adaptive volute, a pressure of the fluid received via the inlet, a pressure change between the inlet and the outlet of the pump, a meridional distribution of static pressure in the volute, power consumed by the pump, a pump motor voltage, a pump motor current, impeller shaft torque, or impeller shaft speed. In some embodiments a rotational speed of the impeller can be variable.

One exemplary method of operating a centrifugal pump in accordance with the present disclosure includes receiving fluid from an outside environment through an inlet of an adaptive volute, rotating an impeller to move the fluid through the adaptive volute, and discharging fluid through an outlet of the adaptive volute. The method further includes adjusting a volute of the adaptive volute by moving a portion of the volute while the volute remains coupled to the impeller.

In some embodiments, the adaptive volute can include an outer collar and an inner collar disposed within a casing thereof. The other collar and the inner collar can be threadably engaged with one another. Adjusting the volume of the adaptive volute can further include rotating the outer collar to cause the inner collar to move axially, thereby adjusting the volume of the adaptive volute. In other embodiments, the adaptive volute can include a top wedge and a bottom wedge disposed within a casing thereof. Adjusting the volume of the adaptive volute can include rotating the top wedge to cause the bottom wedge to translate, thereby adjusting the volume of the adaptive volute. Adjusting the volume of the adaptive volute can occur during operation of the pump. In some embodiments, the method can further include continuously adjusting the volume of the volute to find a volume that maximizes efficiency of the pump. In some instances, the method can include measuring a meridional distribution of static pressure. The volume of the adaptive volute can be adjusted to minimize variation in the static pressure distribution.

In another exemplary embodiment, a centrifugal pump in accordance with the present disclosure includes an impeller and an adaptive volute in which the impeller is disposed. The adaptive volute has an inlet for receiving fluid from an outside environment and an outlet for discharging out of the adaptive volute fluid impelled by the impeller. The adaptive volute is configured to adjust its available volume to achieve a range of best efficiency operation approximately between about 70% of a nominal best efficiency point flow to about 135% of a nominal best efficiency point flow based on at least one parameter.

In some embodiments, the at least one parameter can include one or more of a volumetric flow rate, a differential pressure, a pressure rise between the inlet and the outlet of the volute, or a pump operating efficiency.

In another exemplary embodiment, a centrifugal pump in accordance with the present disclosure includes an impeller and an adaptive volute in which the impeller is disposed. The adaptive volute has an inlet for receiving fluid from an outside environment and an outlet for discharging out of the adaptive volute fluid impelled by the impeller. The adaptive volute is configured to adjust its available volume therein to achieve a flow therethrough that is approximately in the range of about 50% of a nominal flow rate to about 150% of a nominal flow rate based on at least one parameter.

In some embodiments, the at least one parameter can include one or more of a volumetric flow rate, differential pressure, pressure rise between the inlet and the outlet of the volute, or pump operating efficiency.

BRIEF DESCRIPTION OF THE DRAWINGS

This disclosure will be more fully understood from the following detailed description taken in conjunction with the accompanying drawings, in which.

DETAILED DESCRIPTION

Figure 1B:
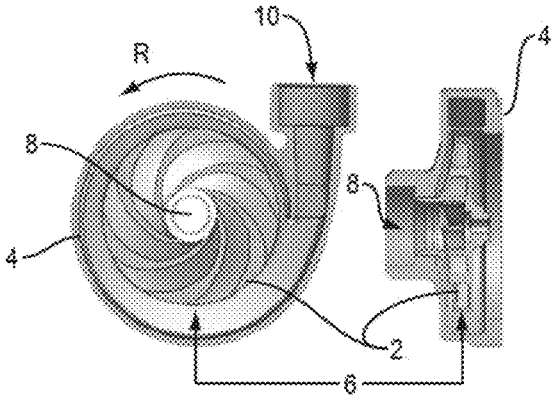
FIG. 1B PRIOR ART
FIG. 1B is a cross-sectional polar view taken along the line Z-Z and a meridional cross-sectional view taken along the line Y-Y of a prior art pump of the pump system of FIG. 1A.
Figure 1A:
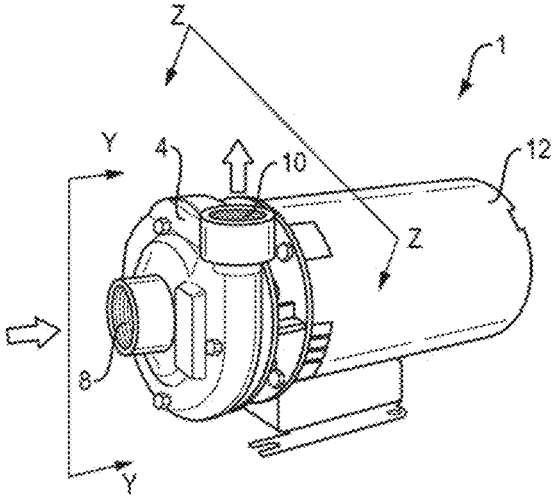
FIG. 1A PRIOR ART
FIG. 1A is a perspective view of a pump system of the prior art.
Figure 1C:
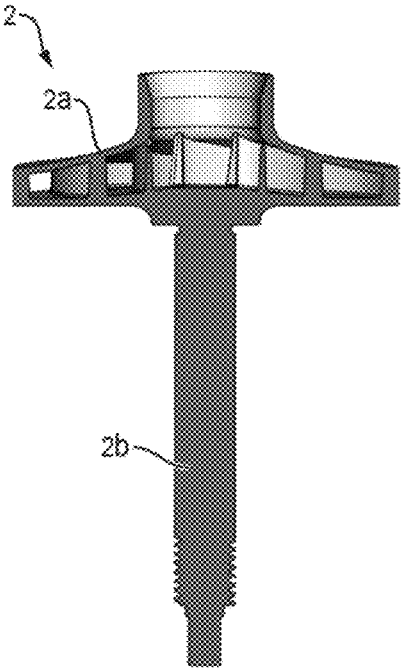
FIG. 1C PRIOR ART
FIG. 1C is a cross-sectional view of a prior art impeller of the pump of FIG. 1B taken along the line Y-Y of FIG. 1A.
Figure 2:
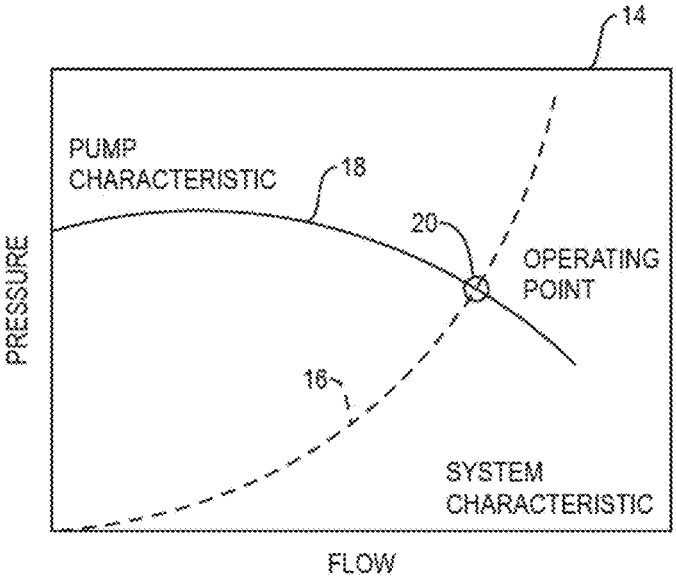
FIG. 2 PRIOR ART
FIG. 2 is a plot illustrating the operating point of the pump of FIG. 1A.

Before discussing the various features of adaptive volutes for use in centrifugal pump systems provided for in the present disclosure, it is helpful to better understand a conventional centrifugal pump system of the prior art. FIGS. 1A-2 relate to conventional centrifugal pump systems. More particularly, FIG. 1A illustrates a pump system 1 of the prior art and FIG. 1B shows a cross-sectional polar view and a cross-sectional meridional view of components of the pump of FIG. 1A, taken along the lines Z-Z and Y-Y, respectively. The pump 1 has a rotating impeller 2 disposed within a casing 4. The casing 4 defines a spiral volute 6 in which the impeller 2 is disposed. The casing 4 has an inlet 8 through which fluid enters and an outlet pipe 10 through which fluid discharges. FIG. 1C is a cross-sectional view of the impeller 2 taken along the line Y-Y of FIG. 1A. The impeller 2 has an impeller head 2*a* and a shaft 2*b* extending longitudinally from it. The shaft 2*b* extends into a motor 12 of the system 1. The motor 12 rotates the impeller 2, which forces fluid from the inlet 8 radially into the volute 4, causing the fluid to flow along the spiral of the volute and deliver it into the outlet pipe 10. The rotating impeller 2 works on the fluid by accelerating the fluid, which increases stagnation pressure. Notably, a geometry of the volute 6 is typically fixed for a particular pump such that the geometry of the volute cannot be adjusted while the impeller 2 is coupled to the volute.

Fluid systems can be characterized based on a required flow Q and static pressure $P_s$ of the system. The system characteristic can be defined by the total pressure rise necessary to move a flow rate Q through the system. FIG. 2 is a pressure-flow graph 14 for a fluid system like the pump 1 of FIG. 1A. It illustrates a system characteristic curve 16, which plots the pressure requirements of the fluid system as a function of flow. The pump 1 is represented by a characteristic curve 18 of static pressure rise generated as a function of flow. The characteristic curve 18 can be experimentally derived once the pump 1 is manufactured. The pump curve 18 indicates how the pump pressure will change with flow. An operating point 20 of the pump 1 is defined by the intersection of the pump curve 18 and the system curve 16 of the particular system to which the pump is connected. In existing real fluid systems, i.e., a system that fluctuates in pressure and flow over time, the system curve 16 changes over the lifetime and operation of the system. Accordingly, the operating point 20 of the pump 1 can shift along the pump curve 18 and can diverge from the best efficiency point of the system. The pump curve 18 typically remains unchanged across the lifetime of the pump 1. In some instances, the pump curve 18 can be intentionally changed by varying impeller rotational speed or impeller trimming, as discussed above.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

Centrifugal pump systems and related methods are disclosed herein for providing improved pump efficiency, improved reliability, and/or broader range of operation across a range of operating conditions and a lifetime of the pump. Centrifugal pumps of the present disclosure can include an impeller and a volute in which the impeller is disposed. The volute can be an adaptive or variable volute such that a geometry of the adaptive volute can be adjusted during operation of the pump. Adjusting the geometry of the adaptive volute can include, for example, adjusting the length, width, height, volume, and/or surface area of the volute, and/or portions of the volute (e.g., a particular side(s) of the volute, a throat, a tongue, etc.). More particularly, non-limiting examples of control parameters that can be adjusted or changed to adapt the volute in accordance with the present disclosures can include a throat area (i.e., a product of a throat width and a throat height), a radial change of a width of the volute, an axial change of a height of the volute, a tongue angle, a cut water radius, and/or a height location of the impeller in the volute (e.g., centered vs. offset). In this manner, the volute geometry can be adjusted during operation of the pump to meet variable system demand and maintain high-efficiency operation across varying operating parameters of the system. As used herein, "during operation of the pump" can refer to an instance in which the impeller is rotating to drive fluid through the pump. More generally, a geometry of the adaptive volutes of the present disclosure can be adjusted while the adaptive volute is coupled to the impeller, i.e., while the impeller remains disposed within the volute. As such, adjustments can be made to adaptive volute geometry without having to open a pump casing, replace a system component, halt pump operation, etc.

Adaptive volutes of the present disclosure can include one or more mechanisms to adjust a cross-sectional area of the volute such that the volute can maintain near uniform static pressure, i.e., best efficiency operation (BEP), around a periphery of the impeller disposed therein. For example, the volute area can be expanded or contracted to shift the BEP of the pump based on one or more operating parameters of the pump and/or fluid system to maintain a higher operating efficiency across a varying range of conditions. The one or more operating parameters can include, without limitation, a volumetric flow rate, differential pressure, pressure rise between a pump inlet and outlet, a desired fluid flow rate for fluid discharged from the volute, a desired fluid volume for fluid discharged from the volute, a pressure of the fluid received via the pump inlet, a pressure change between the inlet and the outlet of the pump, a meridional distribution of static pressure in the volute, power consumed by the pump, a pump motor voltage, a pump motor current, impeller shaft torque, and/or impeller shaft speed. Adjustments to the adaptive volute can be made in real-time, near real-time, or at discrete intervals during operation of the pump. Accordingly, BEP performance can be maintained across a range of operating parameters, even if operating parameters of the system change during pump operation. Adjusting a geometry of the adaptive volute can provide for an expanded operating range.

For example, in some embodiments, the adaptive volute geometry can be adjusted to provide for improved pump efficiency of a flow approximately in the range of about 50% of a nominal BEP flow to about 150% of a nominal BEP flow, in some instances approximately in the range of about 70% of a nominal BEP flow to about 135% of a nominal BEP flow, and in some instances approximately in the range of about 85% of a nominal BEP flow to about 110% of a nominal BEP flow. In some instances, pumps of the present disclosure can provide for BEP operation at flows within the aforementioned ranges. As used herein, "nominal best efficiency flow," also referred to as "baseline flow," refers to a best efficiency point flow of a pump having a static volute geometry sized for a system in which the adaptive volute geometry pump will be used. Pumps of the present disclosure with adaptive volutes and methods related to the same can provide for increased lifetime energy efficiency of the pump, which can lower energy costs and reduce the need for and/or frequency of pump maintenance.

Figure 3:
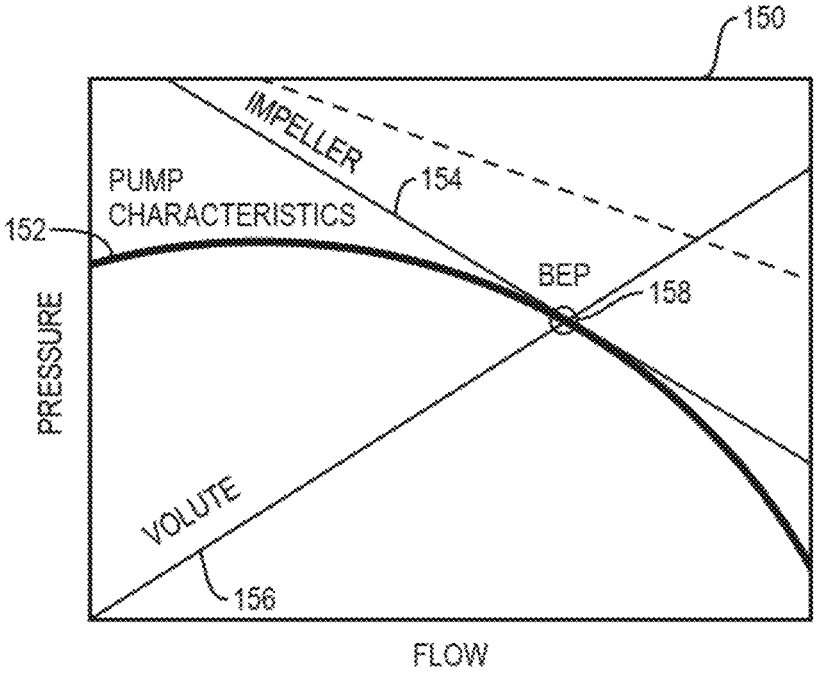
FIG. 3 is a pressure-flow diagram applicable to the present disclosures.

The best operating efficiency of a pump typically occurs when the velocity and pressure are uniform at the impeller and volute interface, which can reduce mixing losses, flow separation, and cavitation. Accordingly, the best efficiency point (BEP) of a pump occurs at an intersection of impeller and volute characteristics. The intersection of the two characteristics may also be referred to as the design point of the pump. At operating point other than the design point, there is a mismatch between the impeller and volute characteristics, which can create variations in flow and pressure around the periphery of the impeller at the off-design operating points. FIG. 3 is a pressure-flow diagram 150 with a plot of a pump characteristic curve 152, an impeller characteristic 154, and a volute characteristic 156. The pressure-flow diagram 150 can represent operation of a pump of the present disclosure, such as the pump 100 that will be described in detail below with reference to FIGS. 4-10. The BEP 158 of the pump can occur at the pressure and flow where the impeller and volute characteristics 154, 156 intersect. The volute characteristic 156 and the impeller characteristic 154 can be approximated by the equations (1) and (2), respectively:

$$P = \eta\Omega\frac{Qr}{A} \tag{1}$$

$$\text{Impeller Characteristic: } P/\eta = P_o - kQ \tag{2}$$

In equations (1) and (2), A is a throat area of the volute, Q is the fluid flow rate, r is the impeller radius, Ω is rotational speed of the impeller, P is the static pressure, k is a constant, and η is hydraulic efficiency.

The volute characteristic 156 can capture the relationship between the volute collecting flow from the impeller and the volute converting the dynamic pressure into a static pressure rise.

The terms in the volute characteristic 156 can be understood as a combination of flow parameters—flow Q and pressure P—and control parameters—impeller rotational speed Ω, impeller radius r, and throat area of the volute A. Accordingly, varying a geometry of the volute can shift the shape of the volute characteristic 156, which can thereby adjust the best efficiency point 158 of the pump. As noted above, centrifugal pumps of the present disclosure can include an adaptive volute such that the geometry of the volute can be adjusted during operation of the pump to shift the operating efficiency of the pump across a range of operating conditions. As such, pumps of the present disclosure can operate at higher efficiencies over a lifetime of the pump. Varying the volute characteristic can provide benefits over approaches that vary the impeller characteristic, e.g., through variable speed drives or impeller trimming. For example, varying a geometry of the volute can be achieved with a simpler mechanism that does not require attachment to, or adjustment of, the rotating component that drives the system. Further, the volute characteristic has a weaker effect on the shape of the pump characteristic, and a strong effect on the location of the BEP. This allows for more direct control over efficiency during operation. More particularly, adaptive volute pumps as disclosed herein can adjust the throat area of the volute A and the cross-sectional area of the volute spiral, according to good volute design practice, such as accounting for conservation of angular momentum and/or constant velocity. In some embodiments, an impeller characteristic of the adaptive volute pumps of the present disclosure can also be adjusted. In other words, impeller trimming and/or variable impeller speed drive can be implemented in adaptive volute pumps, which can provide for a greater control over BEP and/or an expanded operational range.

Adaptive volute pumps of the present disclosure can also be used to vary flow through the pump system, e.g., to better accommodate or match varying flow requirements of a system. In some embodiments, volute volume of pumps of the present disclosure can be adjusted to achieve a flow approximately in the range of about 50% of a nominal flow rate to about 150% of a nominal flow rate. The ability to vary flow to such a range with a single pump can provide cost- and space-saving benefits. For example, if a pump of the present disclosure can provide up to 150% of nominal flow, the number of pumps required to meet a demand of the system can be reduced, saving an operator operational space and overhead cost.

Figure 4:
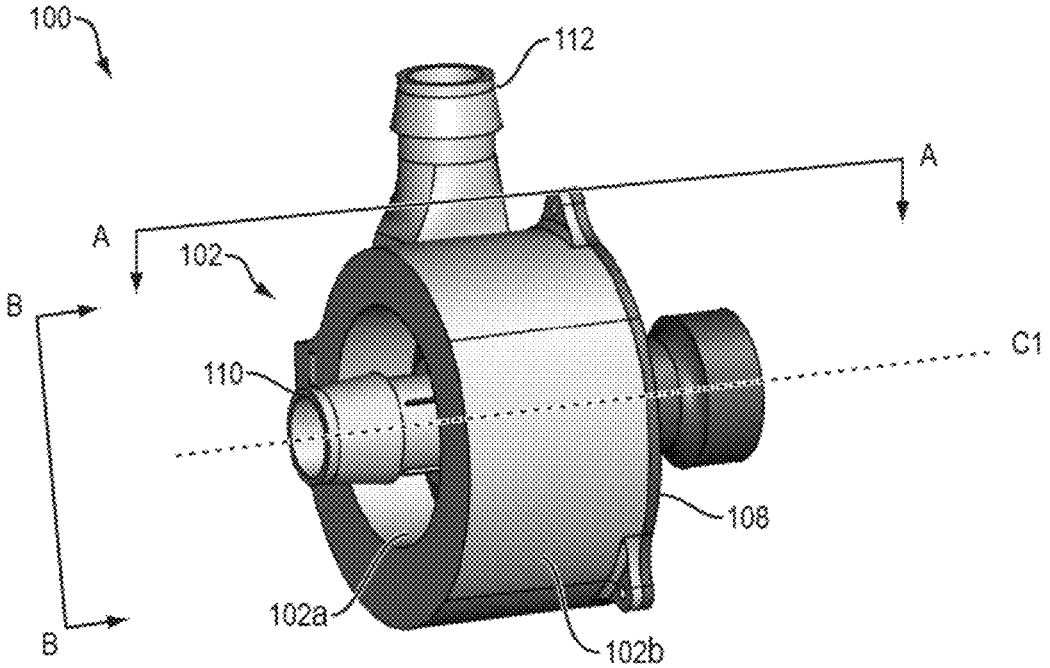
FIG. 4 is a side perspective view of one embodiment of an adaptive volute pump of the present disclosure.
Figure 5:
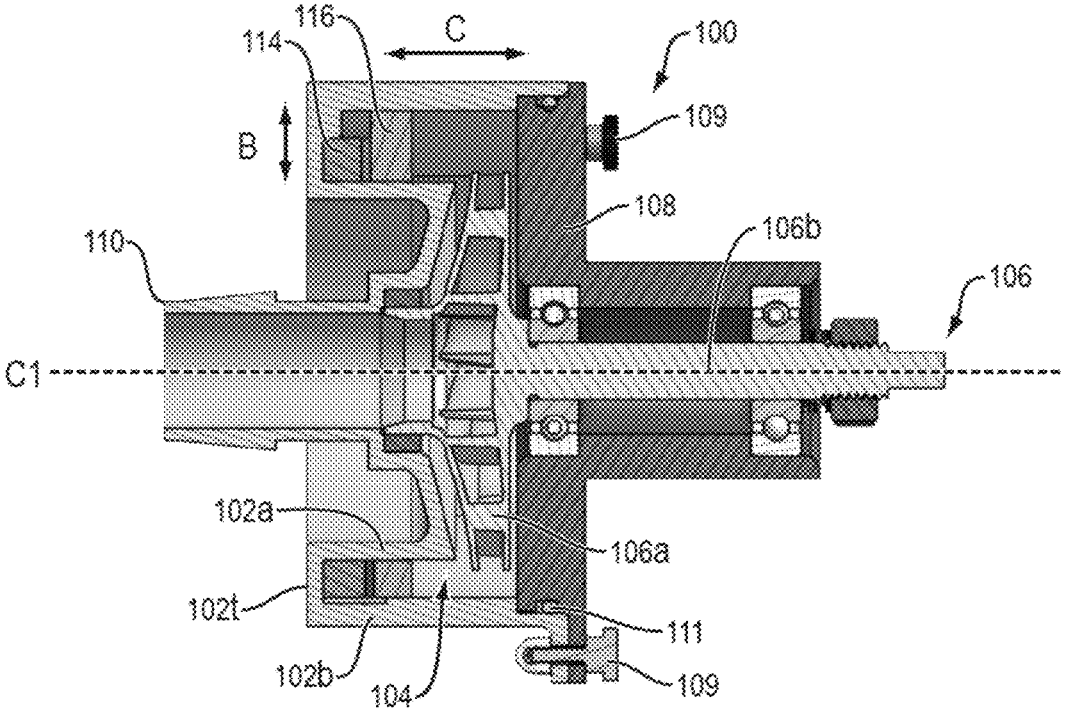
FIG. 5 is a cross-sectional side view of the pump of FIG. 4 taken along the line A-A of FIG. 4.

FIGS. 4-10 illustrate one embodiment of a centrifugal pump 100 of the present disclosure, which can include an adaptive volute with an axial sliding mechanism that can adjust an axial dimension of the volute. FIG. 4 shows the pump 100 having a casing 102 and FIG. 5 is a cross-sectional view of the pump 100 taken along the line A-A of FIG. 4. The pump casing 102 can, at least in part, define an adaptive volute 104. An impeller 106 can be disposed within the volute 104 and can have an impeller head **106*a* and a shaft 106*b* extending longitudinally therefrom. While the embodiment illustrated in FIG. 5 shows a closed impeller, a semi-open or open impeller can alternatively be used with pumps of the present disclosure. The impeller shaft 106*b* can extend through a baseplate 108 of the casing 102 and into a motor (not shown). The motor can drive the impeller 106 to rotate within the volute 104 to drive fluid into the volute from an inlet 110 of the casing 102. A fluid supply pipe (not shown) can be connected to the inlet 110 to supply fluid to the pump 100. Rotation of the impeller 106 can move the fluid radially from the inlet 110, through the volute 104, to an outlet pipe 112 to discharge the fluid from the volute 104. The baseplate 108 can be affixed to the casing 102, e.g., with bolts 109, and can be sealed with a radial O-ring seal 111, a face seal, a gasket, etc. While the illustrated embodiment shows the baseplate 108 as a separate component coupled to the casing 102, in some embodiments the baseplate and the casing can be integrally formed as a single unit. The shape of the casing 102 and, accordingly, the shape of the volute 104 disposed therein, can be a logarithmic spiral that can expand in volume along a path of the fluid flow towards the outlet 112**.

A cross-sectional area of the volute 104 can have a radial dimension B and an axial dimension C. As used herein, the term "axial" refers to a direction that is parallel to a central longitudinal axis C1 that can extend longitudinally and centrally through the inlet 110 of the casing 102. The central longitudinal axis C1 of the pump 100 can also extend longitudinally and centrally along the impeller shaft **106*b* when the impeller 106 is disposed within the volute 104. As used herein, the term "radial" refers to a direction extending radially from the central longitudinal axis C1. The casing 102 can have a top surface 102*t* that can form a closed volume between an inner wall 102*a* and an outer wall 102 of the casing. The inner and outer walls 102*a*, 102*b* of the casing can be designed such that the volume therebetween can increase towards the casing outlet 112. For example, the inner wall 102*a* can have a circular shape while the outer wall 102*b* can have a logarithmic spiral perimeter. Accordingly, the volume therebetween can increase along a fluid flow path towards the outlet 112. As discussed in detail below, the adaptive volute 104 can be defined, at least in part, by the inner wall 102*a*, and the outer wall 102*o* of the casing 102 and the baseplate 108**.

The embodiment of the pump 100 illustrated in FIGS. 4-10 can include an axial slider mechanism that can adjust the axial dimension C of the adaptive volute 104. More particularly, the axial slider mechanism can include a top wedge 114 and a bottom wedge 116 that can be actuated such that the bottom wedge 116 can translate axially within the casing 102 and can thereby adjust the axial dimension C of the volute 104. In this manner, the adaptive volute 104 can be defined radially by the casing 102 and axially by the bottom wedge 116 and the baseplate 108. The top wedge 114 and the bottom wedge 116 can be disposed between the inner and outer walls 102*a*, 102*b* of the casing. The top wedge 114 and bottom wedge 116 can also be referred to as top collar and bottom collar or screw, respectively. As illustrated, the casing 102 and the baseplate 108 can be made from a rigid material such that adjustment to the area of the volute 104 can be defined by a position of the bottom wedge 116. In some embodiments, the bottom wedge 116 can move up to approximately 25 mm in the axial direction, which can provide an expansion or contraction of the axial dimension C of the adaptive volute of approximately 25 mm in either direction. The range of expansion or contraction for a particular adaptive volute can be designed based, at least in part, on a pump size and/or desired efficient operating range.

Figure 6:
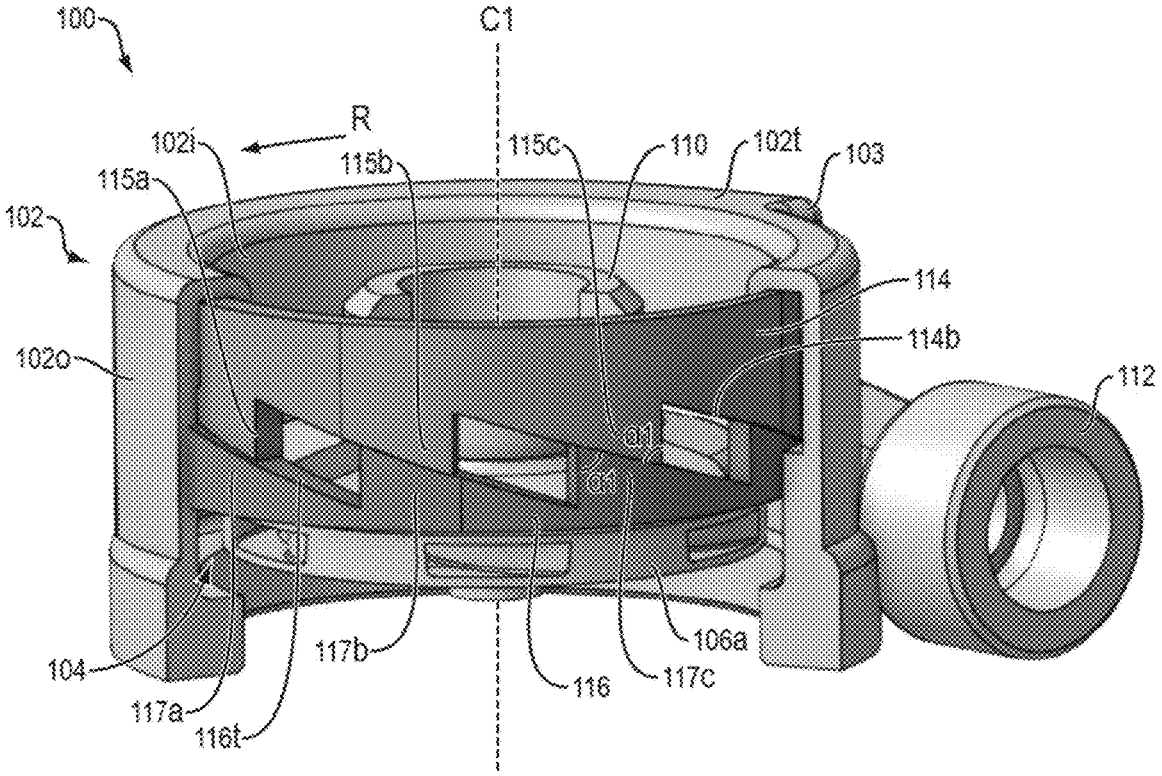
FIG. 6 is a partial cutaway perspective side view of a casing, a top wedge, a bottom wedge, an impeller head, and an adaptive volute of the pump of FIG. 4.

Further details of the axial slider mechanism will now be discussed with reference to FIGS. 6-10. FIG. 6 shows a partial cutaway view of the casing 102 with the top wedge 114 and the bottom wedge 116 disposed therein. The impeller head 106*a* is also illustrated within the adaptive volute 104. The top wedge 114 can be rotated, e.g., by a worm drive 118 (FIG. 9), in a circumferential direction R of the casing 102, while the bottom wedge 116 can be rotationally constrained, e.g., by a rotation stop 103 (FIG. 7) of the casing 102. The top wedge 114 can be engaged with the bottom wedge 116 such that rotational motion of the top wedge can result in translation of the bottom wedge 116 along the axis C1. For example, a bottom edge 114*b* of the top wedge 114 can slidably engage with a top edge 116*t* of the bottom wedge 116 such that rotational movement of the top wedge 114 can be translated into axial translation of the bottom wedge 116. By way of non-limiting example, the bottom edge 114*b* of the top wedge 114 can have a series of sawtooth portions 115*a*, 115*b*, 115*c* that can engage with a counterpart series of sawtooth portions 117*a*, 117*b*, 117*c* on the top edge 116*t* of the bottom wedge 116. By way of non-limiting example, the sawtooth portions can have an angle $\alpha 1$ of approximately 18 degrees. As the bottom wedge 116 is driven proximally, i.e., towards the top surface 102*t* of the casing 102, by the top wedge 114, the axial dimension C of the adaptive volute 104 can increase. On the other hand, as the bottom wedge 116 is driven distally, i.e., away from the top surface 102*t* of the casing 102 and towards the baseplate 108, the axial dimension C of the adaptive volute 104 can decrease. In this manner, the top wedge 114 can be rotated to thereby expand or contract the adaptive volute 104.

Figure 7:
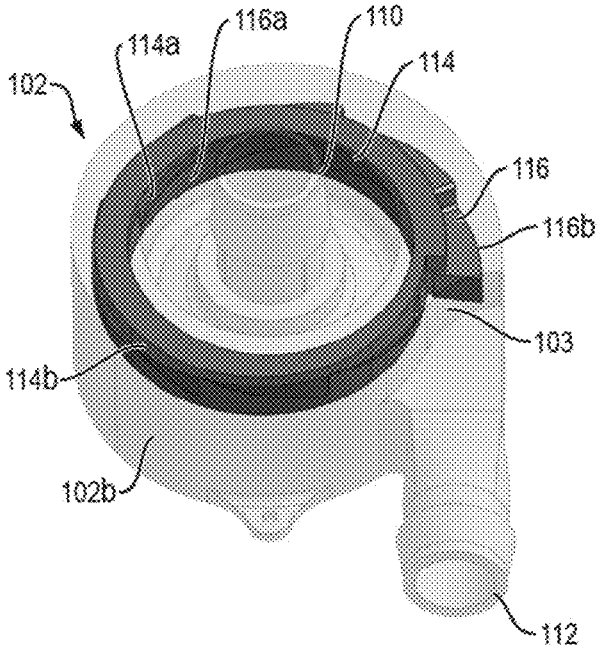
FIG. 7 is a top perspective view of the pump of FIG. 4 with a semi-transparent casing.
Figure 8:
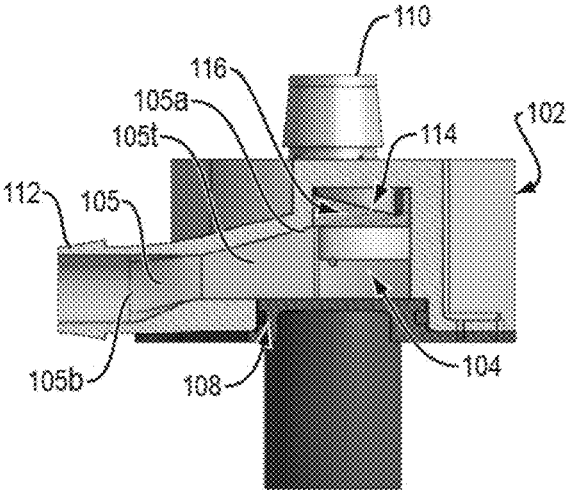
FIG. 8 is a cross-sectional meridian view of the pump of FIG. 4 taken along the line B-B of FIG. 4.

FIG. 7 shows the casing 102 as a semi-transparent component such that the top wedge 114 and the bottom wedge 116 disposed therein are visible. The top wedge 114 can have a cylindrical shape while the bottom wedge 116 can be commensurate in shape with the adaptive volute 104, e.g., a logarithmic spiral. More particularly, the top wedge 114 can extend between an inner wall 114*a* and an outer wall 114*b*. The inner and outer walls 114*a*, 114*b* of the top wedge 114 can be substantially concentric circles, such that the top wedge 114 has a cylindrical shape. The bottom wedge 116 can extend between an inner wall 116*a* and an outer wall 116*b*. The inner wall 116*a* of the bottom wedge 116 can be a circle substantially concentric with the impeller 106, while the outer wall 116*b* can have a perimeter commensurate with the outer wall 102*b* of the casing such that a shape of the bottom wedge 116 can be commensurate with the shape of the adaptive volute 104 formed within the casing 102. As introduced above, the casing 102 can include a rotation stop 103 that can constrain the bottom wedge 116 and prevent the bottom wedge from rotating. FIG. 8 is a cross-sectional view of the pump 100 taken along the line B-B of FIG. 4, which illustrates the sliding engagement of the top wedge 114 and the bottom wedge 116 within the casing 102. A diffuser 105 and/or transition region 105*t* can provide a transition from the volute 104 to the outlet 112. The diffuser 105 can be an expansion that assists in diffusing or slowing down flow, while the transition region 105*t* provides a volume that connects the diffuser 105 with the volute 104. In some embodiments, the diffuser 105 and/or transition region 105*t* can have a geometry that gradually changes along a fluid flow path. For example, as shown, the transition region 105*t* can have a rectangular cross-section at a first end 105*a* thereof and can transition to a circular cross-section at a second end 105*b* that is part of the diffuser 105. In some embodiments, a geometry of the diffuser can be variable during operation of the pump. For example, a flap can extend from the outlet 112 or a point along the diffuser to the second bottom wedge 116 such that translation of the bottom wedge 116 can adjust a geometry of the diffuser.

Figure 9:
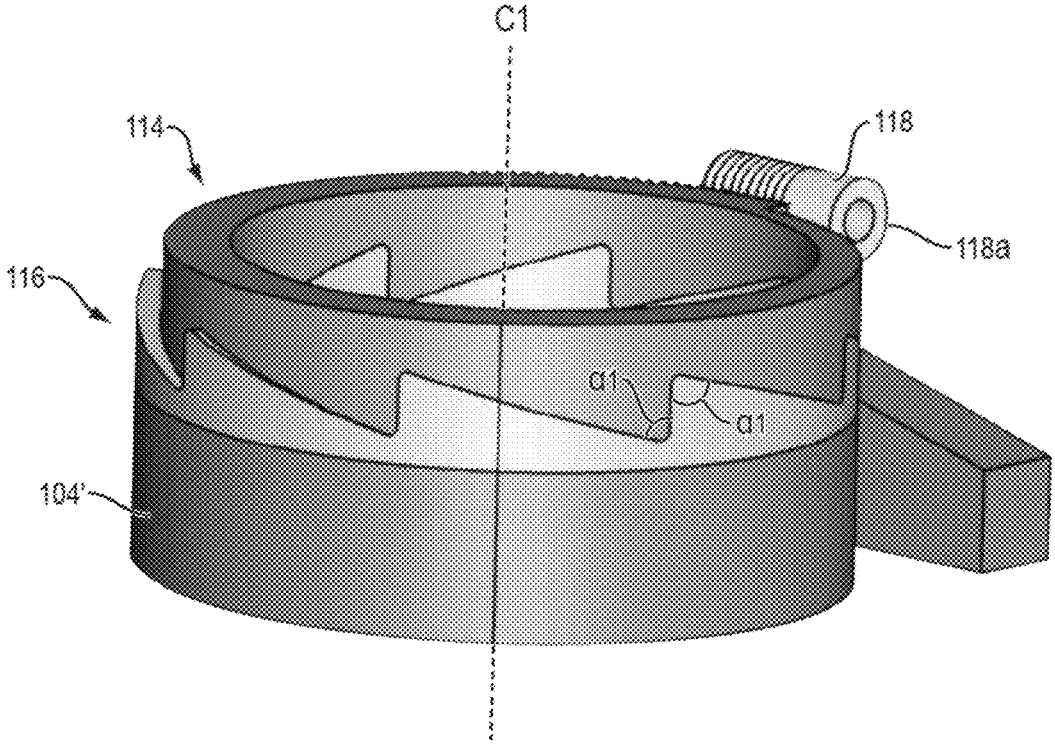
FIG. 9 is a perspective side view of the top wedge, the bottom wedge, the adaptive volute, and a worm gear of the pump of FIG. 4.
Figure 10:
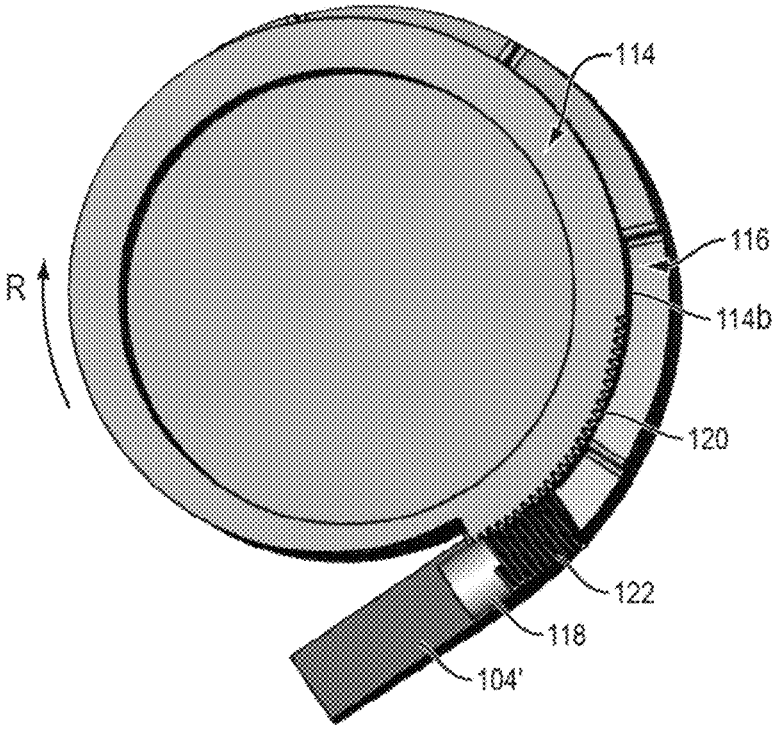
FIG. 10 is a polar view of the components of the pump of FIG. 9.

FIGS. 9 and 10 show isolated side and top views, respectively, of the top wedge 114, the bottom wedge 116, and a worm drive 118. A volume 104' of the adaptive volute 104 is also illustrated. It will be appreciated that the volute volume 104' illustrates the area through which fluid within the adaptive volute 104 can flow, which can be defined by the casing 102, the bottom wedge 116, and the baseplate 108. The worm drive 118 can be actively or passively controlled to drive the top wedge 114 and adjust the geometry of the adaptive volute 104. A plurality of gear teeth 120 can be formed along at least a portion of the outer wall 114*b* of the top gear 114. The worm drive 118 can include external threads 122 that can engage with the gear teeth 120 of the top gear 114 such that rotation of the worm gear causes the teeth of the top gear to move along the threads of the worm gear and rotate the top gear in the direction R about the central longitudinal axis C1. Rotating the worm drive 118 in a first direction can cause the top gear 114 to rotate clockwise about the central longitudinal axis C1, while rotating the worm gear in a second direction opposite the first can cause the top gear 114 to rotate counterclockwise about the axis. As described in detail below, the top wedge 114 can be passively or actively driven, either manually by a user or via connected controller. For example, a head of the worm drive 118*a* can be accessed through the casing 102 such that a user can manually rotate the worm drive 118. Alternatively, the worm drive 118 can be connected to a controller that can drive the worm drive 118 based on one or more system parameters. An angle of the sawtooth portions 115*a*, 115*b*, 115*c*, 117*a*, 117*b*, 117*c* and/or a number of the sawtooth portions can be selected based, at least in part, on a desired force required to actuate the axial adjustment compared to a desired rotation and translation of the top and bottom wedges 114, 116, respectively. The worm threads 120 and the gear teeth 122 can be designed as a function of estimated required output torque to rotate the top wedge 114. FIG. 10 illustrates the spiral shape of the bottom wedge 116, which can, but does not have to, match, or substantially match, a shape of the adaptive volute 104.

As noted above, the cross-sectional area of the adaptive volute 104 can be controlled during operation of the pump 100 such that a high operating efficiency, e.g., operation at a BEP, can be maintained across varying operating parameters. More particularly, the cross-sectional area of the adaptive volute 104 can be adjusted during pump 100 operation to shift the BEP of the pump to match the system demand over a range of operating conditions. The adaptive volute 104 can be adjusted based on one or more operating parameters, such as fluid flow, fluid pressure, impeller speed, etc. or desired operating parameters, e.g., a desired fluid flow rate for fluid discharged from the outlet 112, a desired fluid volume for the fluid discharged from the outlet 112, etc., to shift the BEP point of the pump during operation of the pump. This can better align the pump 100 operating characteristics with current system parameters, which can increase and maintain a high operating efficiency. In some embodiments, a controller can selectively command movement of the top wedge 114 based on the one or more operating parameters or desired operating parameters to adjust the axial dimension C of the volute 104. For example, the controller can drive the worm drive 118 in the first or the second direction to expand or contract the axial dimension C of the volute 104 a desired amount to shift the BEP of the pump 100 based on the operating conditions of the system. Adjustment of the volute 104 can be made in real-time, near-real time, or discrete intervals while the pump 100 is in operation. In some embodiments, the worm drive 118 can be connected to a feedback loop to automatically adjust the adaptive volute 104 based on one or more parameters of the system. For example, a meridional distribution of static pressure can be measured and the volume of the volute can be adjusted to minimize variation in the static pressure distribution. By way of further example, the adaptive volute can be adjusted continuously until a volute volume is located which can maximize pump efficiency. While the embodiment illustrated in FIGS. 4-10 can include the worm drive 118 as a drive mechanism for the top wedge 114, other drive mechanisms, such as a torsion-Bowden cable ellipse drive, a solenoid valve, a ratcheting mechanism, a diaphragm with pressurized fluid, an inlet lead screw, etc., fall within the scope of the present disclosure.

FIGS. 11-16 illustrate another embodiment of a pump 200 of the present disclosure with an adaptive volute 204. As described in detail below, the pump 200 can include an outer collar 214 and an inner collar or screw 216 received within a pump casing 202 that can be actuated to adjust an axial dimension C' of the adaptive volute 204. Except as indicated below or readily apparent to one skilled in the art, the pump 200 can be similar or identical to the pump 100 of FIGS. 4-10, with like-numbered and like-lettered components generally having similar features. Accordingly, description of the structure, operation, and use of such features is omitted herein for the sake of brevity.

Figure 11:
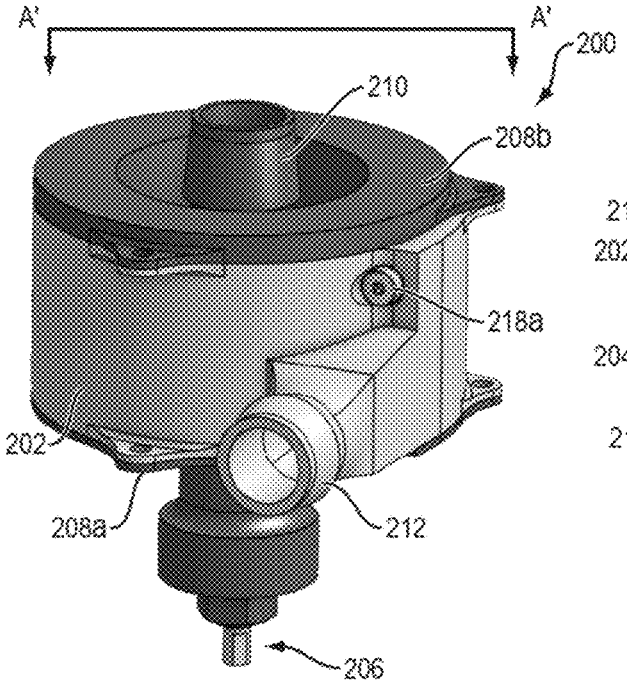
FIG. 11 is a perspective side view of another embodiment of an adaptive volute pump of the present disclosure.

FIG. 11 is a perspective view of the pump 200, which illustrates the pump casing 202, a baseplate 208*a*, and a top plate 208*b*. The top plate 208*b* can include an inlet 210 through which fluid can enter the casing 202 and, more particularly, the adaptive volute 204. The fluid can be driven by an impeller 206 (FIG. 12) radially through the volute 204 and discharged from the volute through an outlet pipe 212. The baseplate 208*a* and the top plate 208*b* can be securely affixed to the casing 202, e.g., with bolts (not shown), such that the baseplate, the top plate, and the casing can form a closed volume through which fluid can flow from the inlet 210 to the outlet 212. As described above, the casing 202 can have a logarithmic spiral shape with a volume of the interior increasing along the fluid flow path towards the outlet 212.

Figure 12:
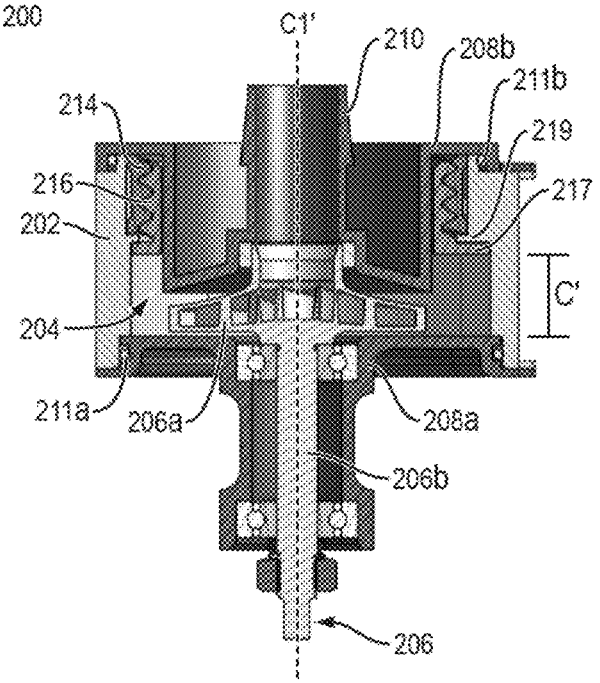
FIG. 12 is a cross-sectional side view of the pump of FIG. 11 taken along the line A'-A' of FIG. 11.

FIG. 12 is a cross-sectional view of the pump 200 taken along the line A'-A' of FIG. 11. As noted above, the baseplate 208*a* and the top plate 208*b* can be affixed to the casing 202 and can be sealed with radial O-ring seals 211*a*, 211*b*, such that the adaptive volute 204 within the casing 202 can be fluid tight. A longitudinal axis C1' of the pump 200 can extend centrally and longitudinally through the inlet 210 of the top plate 208*b* and along a central longitudinal axis of the impeller 206 disposed within the volute 204. The outer collar 214 and the inner collar 216 can be used to expand or contract the axial dimension C' of the volute's 204 cross-sectional area. More particularly, the outer collar 214 and the inner collar 216 can be threadably engaged such that rotation of the outer collar can cause axial translation of the inner collar 216. The outer collar 214 can have a threaded inner surface 214*i* (FIG. 13B) that can engage with a threaded outer surface 216*o* (FIG. 13B) of the inner collar 216. In this manner, the outer collar 216 and the inner collar 214 can form a threadably engaged screw mechanism. The inner collar 216 can have a plunger 217 at a distal end thereof, i.e., an end of the inner collar located towards the baseplate 208*a*, that can move axially with the casing 202 to adjust the axial dimension C' of the volute 204. The plunger 217 can, but does not have to, have a shape commensurate with the shape of the volute 204. For example, in some embodiments, the plunger 217 can have a planar surface in the shape of a logarithmic spiral, commensurate with the volute 204. A fluid seal can be formed between the plunger 217 and the volute 204. The plunger can be located distally of a lip 219 formed within casing 202.

Figure 13A:
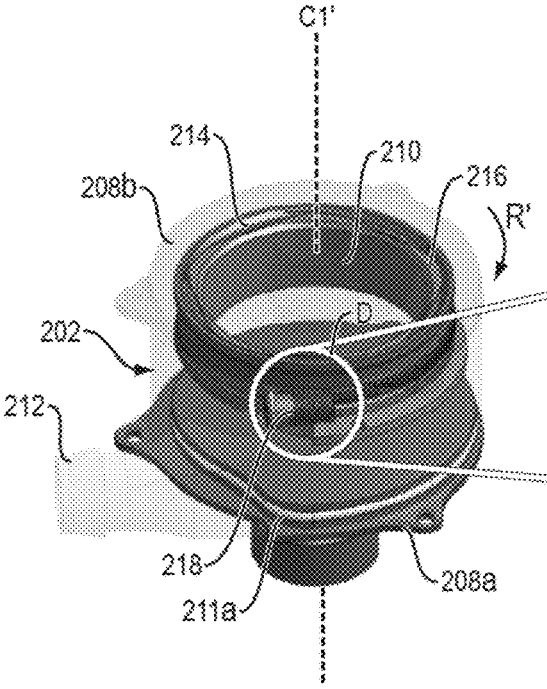
FIG. 13A is a perspective side view of the pump of FIG. 11 with a semi-transparent casing and a top plate.
Figure 13B:
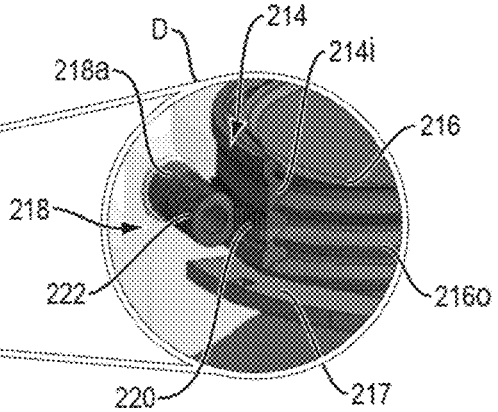
FIG. 13B is a detailed view of a worm gear of the pump illustrated in circle D of FIG. 13A.
Figure 14:
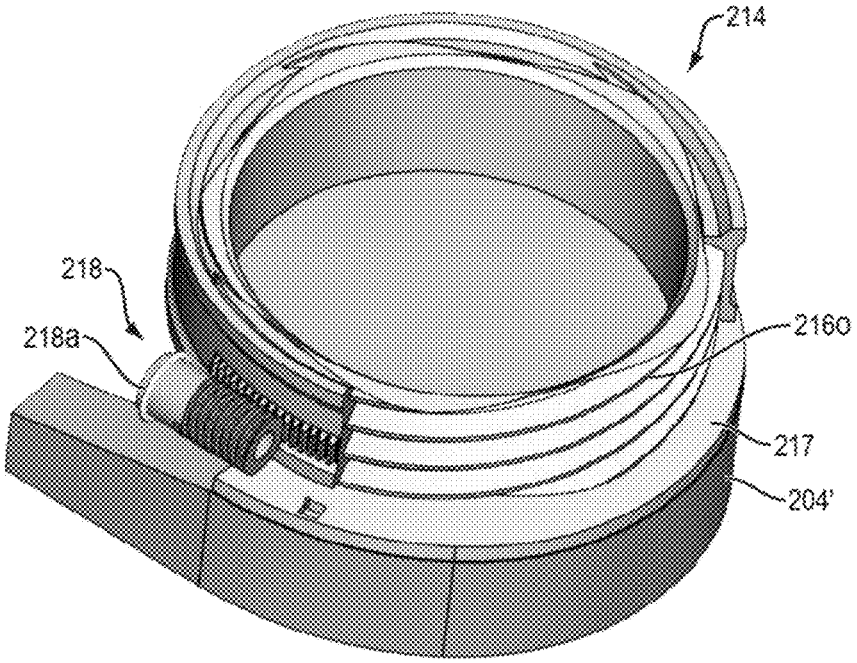
FIG. 14 is a perspective top view of a partial cutaway of an outer collar, an inner collar, the worm gear, and the adaptive volute of the pump of FIG. 11.
Figure 15:
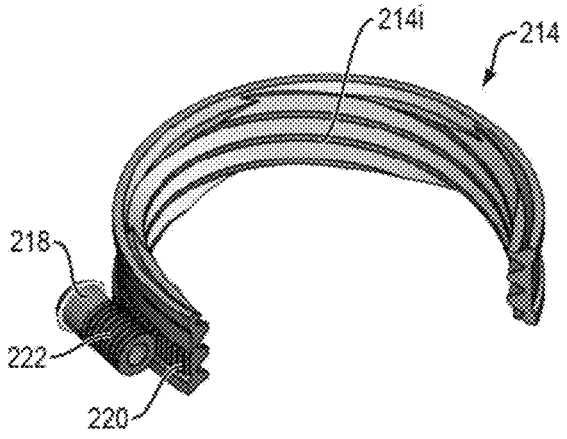
FIG. 15 is a perspective view of the partial cutaway view of the outer collar and the worm gear illustrated in FIG. 14.
Figure 16:
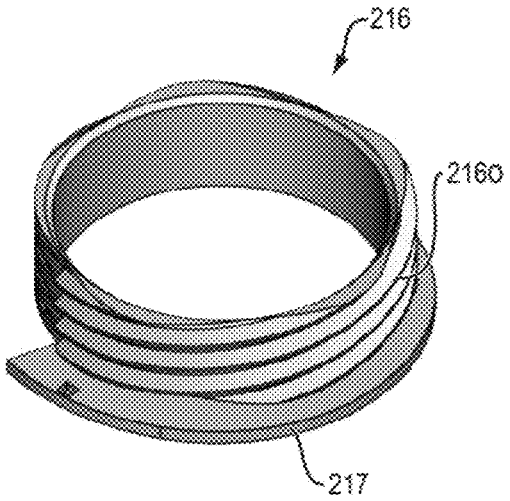
FIG. 16 is a perspective view of the inner collar illustrated in FIG. 14.

The design, operation, and function of the outer collar 214 and the inner collar 216 will now be described in further detail with reference to FIGS. 13A-16. FIG. 13A shows the outer collar 214, the inner collar 216, and a worm drive 218 within the casing 202. The casing 202 and the top plate 208*b* are shown as semitransparent components such that the inner and outer collars 216, 214 and worm drive 218 are visible therethrough. FIG. 13B is a detailed view of the worm drive 218 engaged with the outer collar 214 shown in the circle D of FIG. 13A. FIG. 14 shows a cut-away view of the outer collar 214, the inner collar 216, the worm drive 218, and a volume 204' of the volute 204. FIG. 15 is a detailed view of the cut-away view of the outer collar 214 of FIG. 14, and FIG. 16 is a detailed view of the inner collar 216. A system that uses other methods of transmission, such as cables, traction drives, diaphragms, fluid pressure, etc., can also be implemented without departing from the spirit of the present disclosure.

The worm drive 218 can mate with gear teeth 220 formed along at least a portion of an outer surface 214*o* of the outer collar 214 to transmit torque of the worm gear to the screw mechanism of the collars 214, 216. A head 218*a* of the worm drive 218 can be accessible through an opening in the casing 202, as shown in FIG. 11. Threads 222 of the worm drive 218 can engage with the gear teeth 220 of the outer collar 214 such that rotating the worm gear in a first direction can cause the outer collar to rotate clockwise about the central longitudinal axis C1' of the pump 200, i.e., in a direction of the arrow R' illustrated in FIG. 13A. As the outer collar 214 rotates clockwise, the threaded surface 214*i* of the outer collar can engage the threaded surface 214*o* of the inner collar to translate the inner collar distally, i.e., towards the baseplate 208*a*. As a result, the plunger 217 can compress the volume of the volute 204' (FIG. 14) by reducing the axial dimension C' of the volute 204. As the inner collar 216 is moved distally, the outer collar 214 can push upwards off the lip 219 of the casing 202. Rotating the worm drive 218 in a second direction opposite the first direction can cause the outer collar 214 to rotate in a counterclockwise direction about the central longitudinal axis C1' of the pump 200. As the outer collar 214 rotates in the counterclockwise direction, the inner collar 214 can translate proximally, i.e., away from the baseplate 208*a* and towards the inlet 210, which can expand the volume of the volute 204' by moving the plunger 217 proximally to expand the axial dimension C' of the volute 204. As the inner collar 216 moves proximally, the outer collar 214 can press distally on the casing lip 219. The worm drive 218 can be passively or actively actuated, as discussed above with respect to the embodiment of FIGS. 4-10, based on one or more operating parameters.

The threaded surface 214*i* of the inner collar 214 and the threaded surface 216*o* of the outer collar 216 can be designed as a multi-start screw, which can mitigate jamming and extend the lead of the screw while only moving the outer collar 216 through part of a rotation. For example, the inner and outer collar threads 214*i*, 216*o* can be designed as a multi-start screw with five (5) starts with dimensions shown in Table 1 below. Such a configuration is but one example of dimensions for the threaded surfaces 214*i*, 216*o* of the inner and outer collar. Alternative dimensions, and number of starts (e.g., as few as one and more than five), are within the scope of the present disclosure.

TABLE 1

Non-limiting Example of Threaded Collar Dimensions

| Variable | | Value | Unit |
|---|---|---|---|
| pitch | p | 6 | mm |
| major diameter | $d_m$ | 80 | mm |
| screw starts | s | 5 | # |
| lead | l | 30 | mm |
| lead angle | λ | 0.119 | rad |
| | | 6.81 | deg |
| desired travel | t | 10 | mm |
| rotations needed | | 0.33 | rot |
| | | 120 | deg |
| start angles | | | |
| | 1 | 0 | deg |
| | 2 | 72 | deg |
| | 3 | 144 | deg |
| | 4 | 216 | deg |
| | 5 | 288 | deg |

The pump 200 can be assembled by inserting the outer collar 214 top-down into the casing 202. The inner collar 216 can be inserted bottom-up into the casing 202 such that the threaded outer surface 216*o* of the inner collar 216 can engage with the threaded inner surface 214*i* of the outer collar 214. The outer collar 214 can be rotated to pull the inner collar 216 proximally until the threaded surfaces 214*i*, 216*o* are fully mated. In this fully mated configuration, the plunger 217 of the inner collar 216 can be distal of the casing lip 219. The top plate 208*a* and the bottom plate 208*b* can be secured to the casing 202 once the outer collar 214 and the inner collar 216, respectively, are received therein.

While FIGS. 4-16 illustrate various embodiments of pumps of the present disclosure with mechanisms that can adjust an axial dimension C, C' of an adaptive volute 104, 202, alternative mechanisms may be implemented in accordance with the present disclosure to adjust a geometry of an adaptive volute. Again, except as indicated below or readily apparent to one skilled in the art, the various alternative embodiments described below can be similar or identical to the pumps 100, 200, with like-numbered and like-lettered components generally having similar features. Accordingly, description of the structure, operation, and use of such features is omitted herein for the sake of brevity.

Figure 17:
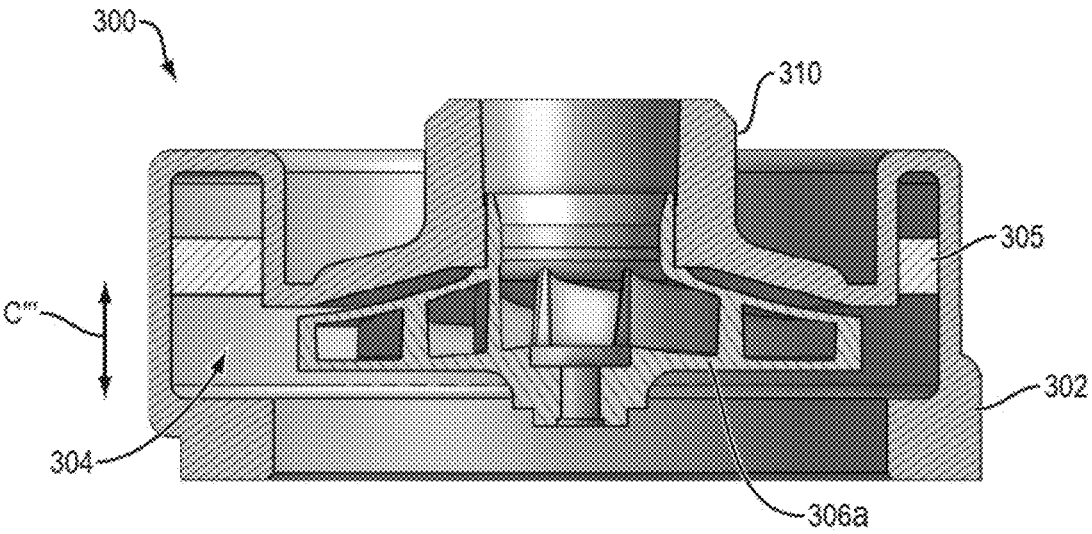
FIG. 17 is a schematic cross-sectional side view of an embodiment of an adaptive volute of the present disclosure.

One alternative embodiment of a pump 300 is illustrated in FIG. 17. As shown, a pump casing 302 that can be part of a centrifugal pump, as described above, can have an adaptive volute 304 disposed therein. A block 305 can be disposed within the casing 302 and can be controlled to translate axially within the casing, thereby adjusting an axial dimension C" of the adaptive volute 304. The block 305 can, but does not have to, have a shape commensurate with the adaptive volute 304, e.g., a logarithmic spiral. The block 305 can form a seal with the casing 102 to prevent fluid leakage from the adaptive volute 304. The block 305 can be selectively translated using, for example, a solenoid valve, a diaphragm with pressurized fluid, an inlet lead screw with non-back drivable gearing, a torsion-Bowden cable ellipse drive, etc. Control of the block 305 can be based on one or more operating parameters of the system, as described above.

Figure 18:
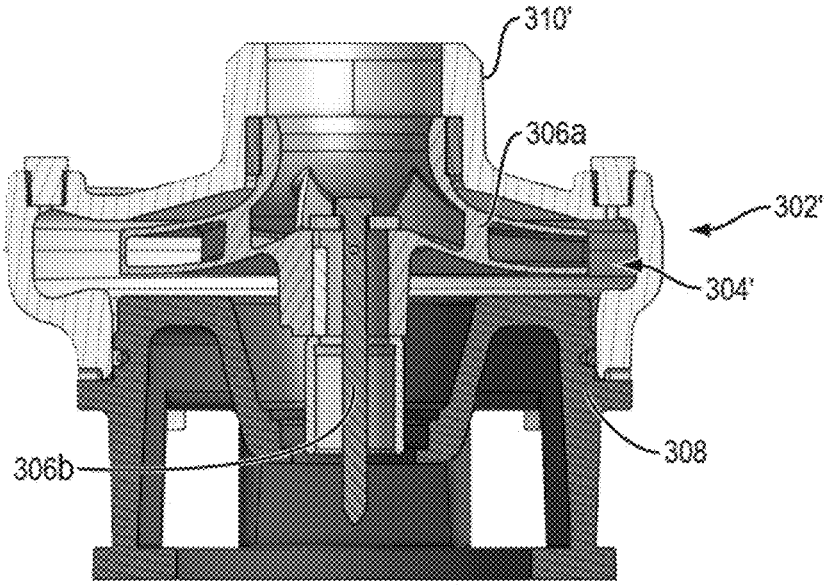
FIG. 18 is a cross-sectional side view of another embodiment of a pump casing of the present disclosure.

As shown in FIG. 18, in some embodiments, pumps of the present disclosure can have a flexible casing 302' such that the casing can bend or flex with movement of an axial adjustment mechanism, e.g., the axial slider 304, the wedges 114, 116, the collars 214, 216. Flexible elements can be attached to the casing 302' to ease a transition between a static pipe geometry of a pipe connected to an inlet 310 of the casing and an adjustable volute 304' of the present disclosure disposed therein.

Figure 19:
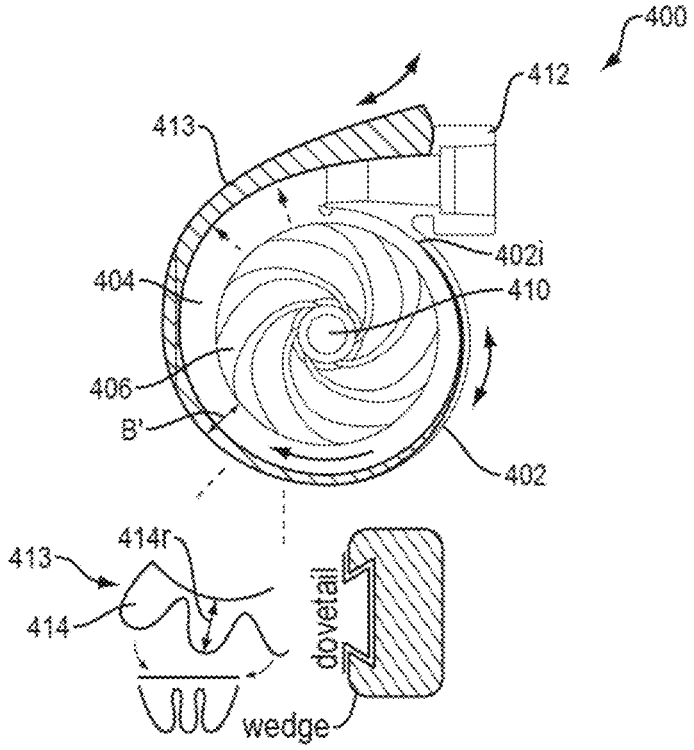
FIG. 19 is a cross-sectional top view of another embodiment of an adaptive volute pump of the present disclosure.

FIG. 19 shows a cross-sectional view of another embodiment of a pump 400 with an adaptive volute 404 of the present disclosure. The pump 400 can include a radial adjustment mechanism that can adjust a geometry of the adaptive volute 404 by changing a radial dimension B' of the volute. The pump 400 can have a casing 402 that can house the adaptive volute 404. An impeller 406 can be disposed within the volute 404 and can rotate to drive fluid into the volute 404 from an inlet 410 of the casing 402. The impeller 406 can move the fluid radially through the volute 404 towards an outlet 412 of the casing 402. As described above, the casing 402 and the volute 404 can have an expanding volume along the fluid path F towards the outlet 412. The pump 400 can include a flexible wedge 413 that can extend along a perimeter of the adaptive volute 404. The flexible wedge 413 can move radially inwards and outwards, i.e., towards and away from, a central longitudinal axis of the pump 400 that can extend centrally and longitudinally through the pump inlet 410. In this manner, the geometry of the adaptive volute 404 can be adjusted by changing a radial dimension B' of the volute. By way of non-limiting example, the flexible wedge 413 can move up to approximately 25 mm in the radial dimension. The range of expansion or contraction for a particular adaptive volute can be designed based, at least in part, on a pump size and/or desired efficient operating range.

In some embodiments, the flexible wedge 413 can include a plurality of wedge portions 414 that can extend radially from a base 416. In some embodiments, the flexible wedge 413 can include a series of sawtooth wedges, e.g., as described above with respect to FIG. 6. Pressure in the volute 404 can pre-load the flexible wedge 413 against an inner wall 402*i* of the casing 402. A radial height 414*r* of the wedge portions 414 can vary along the flexible wedge 413 as a radius of curvature of the volute 404 varies along the logarithmic spiral towards the outlet 412

Figure 20:
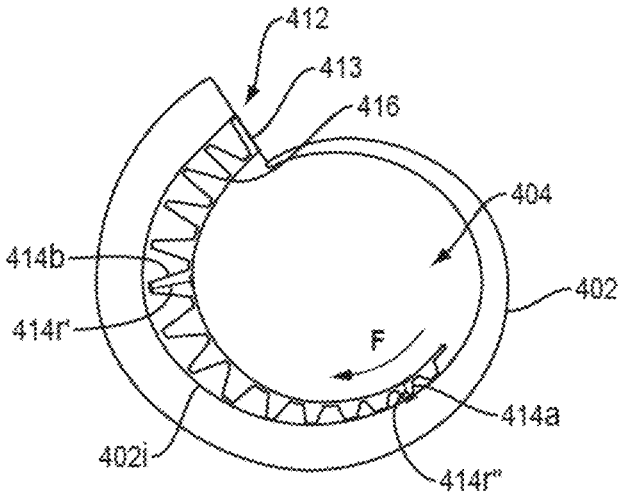
FIG. 20 illustrates one embodiment of a radial adjustment wedge of the pump of FIG. 19.

FIG. 20 shows one embodiment of the flexible wedge 413 with a plurality of wedges 414 of FIG. 19 placed within the casing 402. A first wedge portion 414*a* can be located further away from the outlet 412 on the fluid path F than a second wedge 414*b* such that a radius of curvature of the casing 402 is less at a location of the first wedge portion than the second wedge portion. Accordingly, a radial height 414*r*' of the first wedge portion 414*a* can be less than a radial height 414*r*" of the second wedge portion. This can maintain a logarithmic shape of the adaptive volute 404 despite adjustments to the radial dimension B' of the volute.

Figure 21:
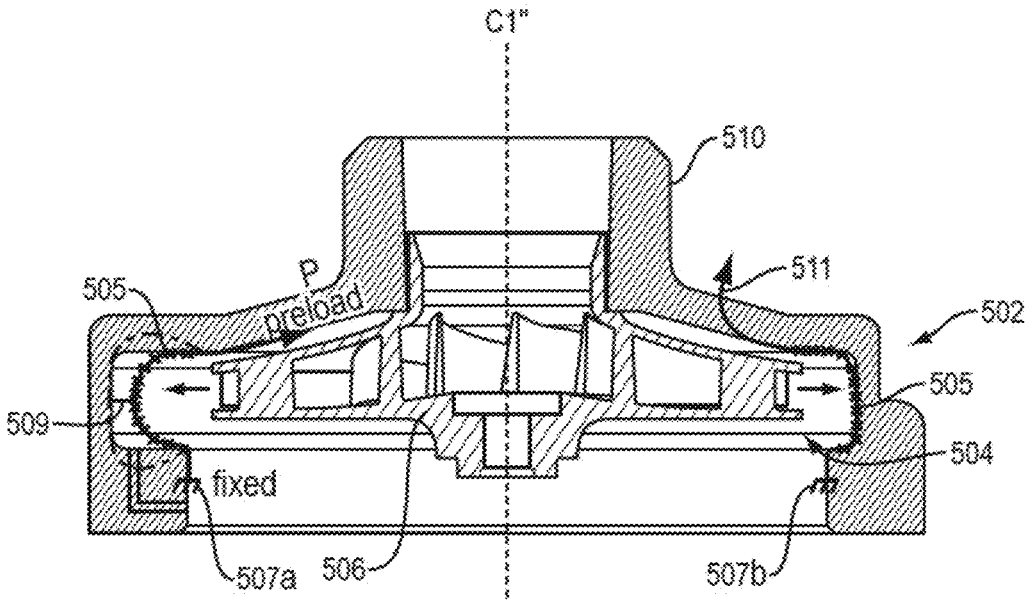
FIG. 21 illustrates another embodiment of an adaptive volute of the present disclosure.

FIG. 21 illustrates another embodiment of a pump casing 502 with an adaptive volute 504 of the present disclosure. More particularly, an adaptive hydraulic mechanism can include a diaphragm or membrane 505 that can adjust a volume of the volute 504 based on one or more operating condition. The membrane 505 can be made from a flexible material such that the membrane can move within an interior of the casing 502 to expand or contract a volume of the volute 504. The casing 502 can have a fluid inlet 510 with a longitudinal axis C1" of the casing extending longitudinally and centrally through the inlet. The membrane 505 can be fixed to an inner wall 502*i* of the casing 502 on either side of the longitudinal axis C1" of the casing 502. For example, the membrane 505 can be fixed to the casing at least at a first fixture point 507*a* on a first side of the longitudinal axis C1 and a second fixture point 507*b* on a second side of the longitudinal axis opposite the first. In some embodiments, the first and second fixture points 507*a*, 507*b* can be located outside the adaptive volute 504. In the embodiment illustrated in FIG. 21, the first and second fixture points 507*a*, 507*b* can be located distal to the adaptive volute 504 towards a baseplate (not shown).

The membrane 505 can be pre-loaded such that the membrane is a distance 509 from the inner wall 502*i* of the casing 502. A positioning of at least a portion of the membrane 505 disposed within the adaptive volute 504 can be passively and/or actively adjusted relative to the inner wall 502*i* of the casing 502, which can thereby change a volume of the volute. For example, fluid can enter through the inlet 510 and can be moved into the adaptive volute 504 by an impeller 506. The fluid can flow radially in a direction F from the impeller 506, the pressure of which can adjust the positioning of at least a portion of the flexible membrane 505 within the casing 502. In some embodiments, the membrane 505 can be actively manipulated to adjust a positioning thereof using, for example, an actuation lead 511 that can extend from the membrane 505 to an exterior of the casing 502. The membrane 505 can be manually or automatically adjusted based on one or more operating conditions, as described above, to adjust a volume of the volute 504.

Figure 22:
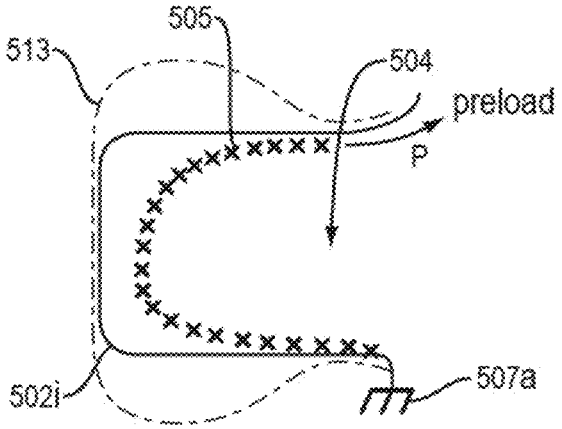
FIG. 22 is a detailed view of an elastic membrane adjustment mechanism of the adaptive volute of FIG. 21.

FIG. 22 illustrates a detailed view of the membrane 505 on one side of the casing 502 of FIG. 21. The membrane 505 can be pre-loaded on at least one side in a direction P towards the inlet 510. In some embodiments, a constraining wall 513 and/or fluid back pressure can counter a force on the membrane 505 from fluid impelled by the impeller 506. Such constraining wall 513 and/or back pressure can provide stability to the membrane 505 and can assist in achieving a uniform static pressure condition.

Figure 23:
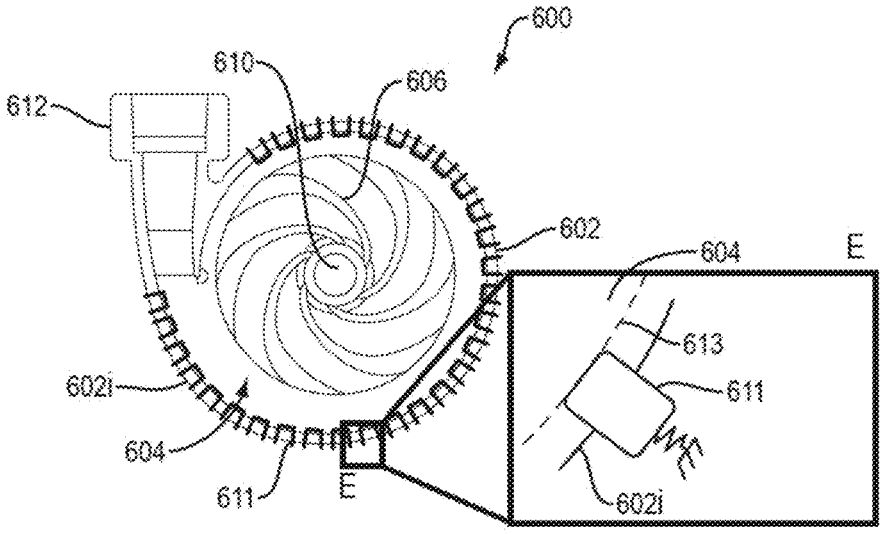
FIG. 23 is another embodiment of an adaptive volute pump of the present disclosure with an active boundary adjustment mechanism.

FIG. 23 illustrates another embodiment of a pump 600 of the present disclosure with a casing 602 having an adaptive volute 604 disposed therein. An impeller 606 can be disposed within the volute 604 and can move fluid from an inlet 610 of the casing 602 radially through the volute towards an outlet 612. As noted above, the casing 602 and the volute 604 can, but do not have to, have a logarithmic spiral shape. A cross-sectional or throat area of the volute can expand towards the outlet 612. The pump 600 can include one or more actuator 611 that can be activated to adjust a geometry of the volute 604, as described in further detail with reference to inset E of FIG. 23 and FIG. 24. Inset E provides a detailed illustration of an actuator 611 and a portion of an inner wall 602*i* of the casing. A membrane 613 can form a boundary layer between the volute 604 and the inner wall 602*i* of the casing 602. The actuator 611 can be actively controlled to move the membrane 613 towards or away from the inner wall 602*i* of the casing, thereby expanding or contracting a geometry of the volute 604. As illustrated in FIG. 23, the pump 600 can include a plurality of actuators 611, which can be controlled individually, in a group subset of the whole, or as a whole to adjust at least a portion of the membrane 613 relative to the inner wall 602*i* of the casing to vary the volute 604. Control of the actuator(s) 611 and, accordingly, the geometry of the volute 604, can be based one or more operating parameters of the system, as discussed above.

Figure 24:
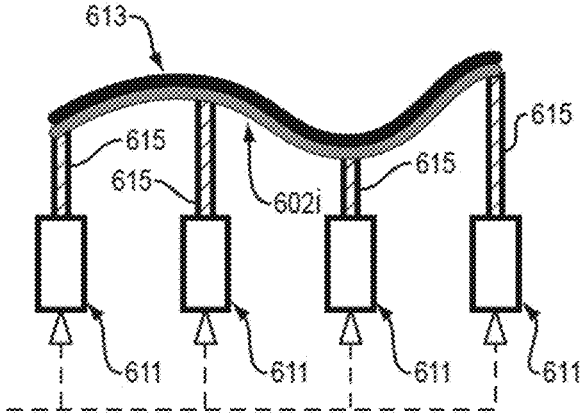
FIG. 24 is a detailed view of the active boundary adjustment mechanism of FIG. 23.

FIG. 24 shows a detailed view of four actuators 611 of the pump 600 that can be used to control positioning of the membrane 613 and can thereby adjust a geometry of the volute 604. In some embodiments, a pin 615 can extend from each actuator 611 to a portion of the membrane 613. The actuator 611 can be activated to move the pin 615 radially inwards or outwards, e.g., towards or away from a central longitudinal axis of the pump 600 that can extend through the inlet 610, respectively. The membrane 613 can move with the pin 613 to adjust a geometry of the volute 604. In some embodiments, a plurality of pins 615 can be controlled by a single actuator 611 such that adjustment of the membrane 613 can be synchronized across an extended portion of the membrane. For example, a plurality of pins 615 can extend from a wedge (not shown) such that a single actuator 611 can actively control movement of the wedge, which can result in movement of the plurality of pins and the associated portions of the membrane 613.

Figure 25:
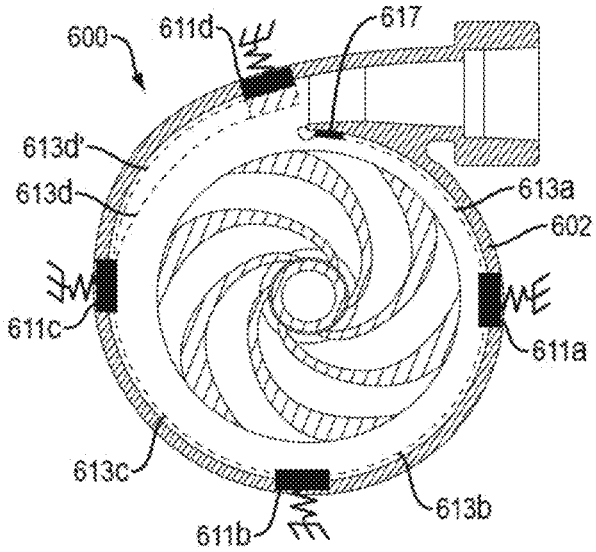
FIG. 25 illustrates another embodiment of a pump of the present disclosure with an active boundary adjustment mechanism.

FIG. 25 illustrates the pump 600 with one example of positioning of the membrane 613 with the actuators 611. For simplicity of illustration, four actuators 611*a*, 611*b*, 611*c*, and 611*d* are illustrated in FIG. 25. It will be appreciated, however, that a fewer or more actuators 611 can be present. The membrane 613 can be affixed to the casing 602 at an origin point 617. In some embodiments, the origin point 617 can be at a narrowest point of the spiral surface of the casing 602. In the illustrated embodiment, a single actuator 611*d* can be activated to move a portion of the membrane radially inwards towards the inlet 610. As can be seen, segments of the membrane 613*s*, 613*b*, 613*c* extending between the origin point and the three non-activated actuators 611*a*, 611*b*, 611*c* can remain in an initial position relative to the inner wall 602*i* of the casing. The segment of the membrane 613*d* extending between the activated actuator 611*d* and the adjacent non-activated actuator 611*c*, however, can be placed in a radially inwards position, i.e., further away from the casing wall 602*i*, as compared to an initial position 613*d*' of that membrane segment. Accordingly, a geometry of the adaptive volute 604 can be reduced as a result of placing at least a portion of the membrane 613*d* in a radially inwards position.

EXPERIMENTAL RESULTS

Pumps with adaptive volutes of the present disclosure can be used to shift the best efficiency point flow of a pump. For example, in some embodiments, pump efficiency can be improved by approximately 2% as a result of adjusting a geometry of an adaptive volute. Table 2, below, shows experimental and analytical flow and pressure at a best efficiency point of a pump for a baseline volute condition, an adaptive volute adjusted axially to receive 85% of the baseline flow, an adaptive volute adjusted axially to receive 110% of the baseline flow, and an adaptive volute adjusted radially to receive 110% of the baseline flow.

TABLE 2

Comparison of calculated and experimental best efficiency points
Experimental and Analytical Flow and Pressure at BEP

| | Flow [m³/hr] | | Pressure [kPa] | | | |
|---|---|---|---|---|---|---|
| | Analytic | Exp | Analytic | Exp | Efficiency Original | Efficiency Experiment |
| Stock | — | 16.4 | — | 294 | — | 71.3% |
| Baseline | 16.4 | 16.4 | 302 | 303 | — | 70.9% |
| 85% axial | 13.6 | 14.9 | 319 | 313 | 70.1% | 69.9% |
| 110% axial | 18.2 | 18.4 | 270 | 288 | 70.6% | 72.6% |
| 110% radial | 18.2 | 18.2 | 270 | 284 | 70.6% | 71.2% |
| 85% radial | 13.6 | — | 319 | — | — | — |

Figure 26:
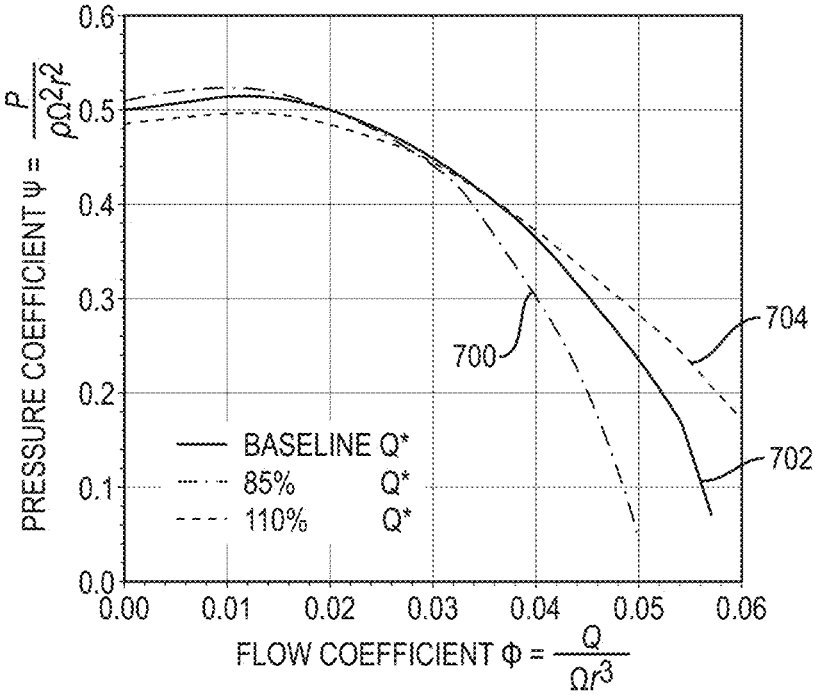
FIG. 26 is a normalized pressure-flow graph of pumps with varying volute geometries.
Figure 27:
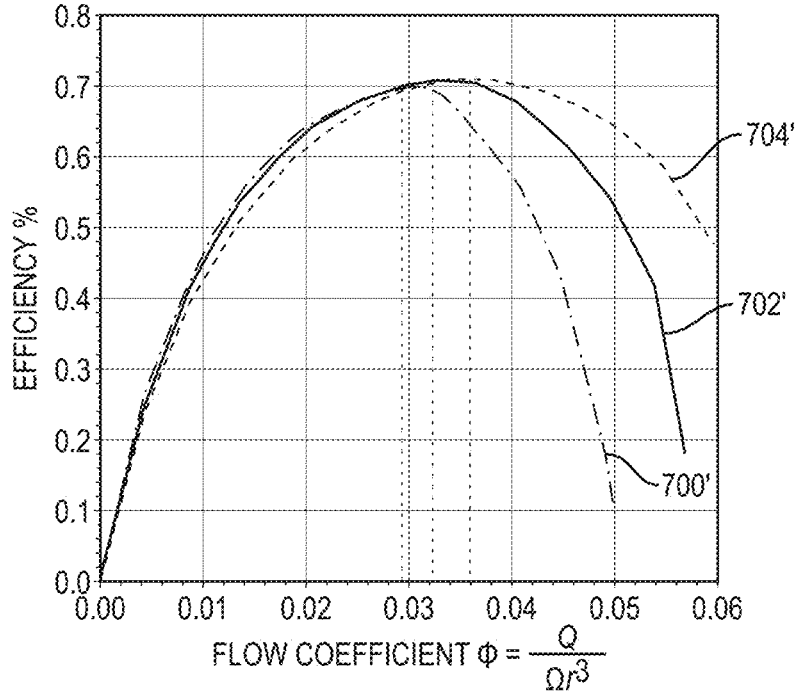
FIG. 27 is a normalized efficiency-flow graph of pumps with varying volute geometries.

These results indicate that axial and radial adjustment of the adaptive volute can shift the BEP of a pump. Tests were conducted to compare the baseline volute, an 85% flow volute geometry, and a 110% flow volute geometry. FIGS. 26 and 27 illustrate a clear shift in the BEP in conjunction with a change in the adaptive volute geometry. More particularly, FIG. 26 plots the pressure-flow curves of the 85% flow volute 700, the baseline volute 702, and the 110% flow volute 704. FIG. 27 plots the efficiency-flow curves of the 85% flow volute 700', the baseline volute 702', and the 110% flow 704'. The 85% flow volute can result in a leftward shift in the efficiency curve 700' with a steeper drop-off on the right-hand side of the curve as flow increases, as compared to the baseline efficiency curve 702'. The 85% flow volute can provide for higher efficiencies at lower flow rates. This can result in improved diffusion of the flow and better conversion to static pressure in the volute. This can be observed in the higher values on the pressure-flow curve for the 85% flow volute 700, as compared to the pressure-flow curves for the baseline volute 702 or the 110% flow volute 704. The 110% flow volute can result in a rightward shift of the efficiency curve 704' towards higher flows, as compared to the baseline volute efficiency curve 702. Furthermore, while the 110% flow volute can greatly expand pump flow capacity, with notable increases in efficiencies at higher flow rates.

One skilled in the art will appreciate further features and advantages of the disclosure based on the above-described embodiments. Accordingly, the disclosure is not to be limited by what has been particularly shown and described, except as indicated by the appended claims. All publications and references cited herein are expressly incorporated herein by reference in their entirety.

What is claimed is:

1. A centrifugal pump, comprising:

an impeller; and a volute defined by a casing having a top plate, the impeller disposed within the volute, the volute having an inlet formed in the top plate for receiving fluid from an outside environment and an outlet for discharging fluid impelled by the impeller out of the volute, the impeller including a radially outer surface from which fluid is impelled into the volute, the volute including a first collar and a second collar disposed within the casing, the second collar having a distal end and a proximal end, the distal end being located closer to the impeller than the proximal end, the second collar including a plunger at the distal end, the plunger being arranged radially outward of the impeller and the inlet, the first collar and the second collar being configured such that the second collar moves axially in response to rotation of the first collar selectively towards or away from the top plate, thereby changing an axial dimension of a cross-sectional area of the volute by moving the plunger axially to adjust a flow of the fluid impelled by the impeller and out of the volute, the first collar contacting the top plate, wherein the plunger is configured to be axially moved to a maximum axial position defining a maximum axial dimension of the cross-sectional area of the volute that is greater than an axial extent of the radially outer surface of the impeller.

2. The centrifugal pump of claim 1, wherein the first collar is an outer collar and the second collar is an inner collar, and wherein the outer collar and inner collar are threadably engaged such that rotation of the outer collar causes the inner collar to move axially within the casing.

3. The centrifugal pump of claim 2, wherein the plunger is configured to define an axial dimension of the adaptive volute.

4. The centrifugal pump of claim 1, wherein the first collar is configured to rotate about a longitudinal axis of the pump, the longitudinal axis of the pump extending substantially centrally through the inlet of the volute and an impeller shaft of the impeller, and the second collar is configured to translate axially along the longitudinal axis of the pump.

5. The centrifugal pump of claim 1, wherein the first collar has a shape defined by an inner circumference and an outer circumference, the shape of the first collar being substantially concentric with a shape of the impeller, and wherein the second collar has a shape defined by an inner circumference and an outer circumference, the inner circumference of the second collar being substantially concentric with the shape of the impeller and the outer circumference of the second collar having a shape that is commensurate with a shape of an inner wall of the volute.

6. The centrifugal pump of claim 5, wherein the outer circumference of the second collar is a logarithmic spiral that substantially matches an expanding shape of the inner wall of the volute.

7. The centrifugal pump of claim 1, wherein the second collar is adjustable such that it can be selectively moved with respect to the casing of the volute to change the cross-sectional area of the volute.

8. The centrifugal pump of claim 7, further comprising a controller configured to command selective movement of the first collar based on one or more parameters.

9. The centrifugal pump of claim 8, wherein the one or more parameters comprise at least one of a desired fluid flow rate for the fluid discharged from the volute, a desired fluid volume for the fluid discharged from the volute, a pressure of the fluid received via the inlet, a pressure change between the inlet and the outlet of the pump, a meridional distribution of static pressure in the volute, power consumed by the pump, a pump motor voltage, a pump motor current, impeller shaft torque, or impeller shaft speed.

10. The centrifugal pump of claim 1, wherein an axial extent of the first collar is greater than half of an axial extent of the second collar.

11. A centrifugal pump, comprising:

a casing defining an interior cavity;

an impeller disposed in the interior cavity;

a volute disposed in the interior cavity, wherein the casing comprises:

a top plate with an inlet formed therein, the inlet being configured to receive fluid from an outside environment such that fluid flowing therethrough contacts the inlet of the top plate; and an outlet for discharging fluid impelled by the impeller out of the volute;

a first collar disposed within the casing and in contact with the top plate; and a second collar disposed within the casing, the second collar having a distal end and a proximal end, the distal end being located closer to the impeller than the proximal end, and the second collar including a plunger at the distal end, wherein the first collar and the second collar are configured such that the second collar moves axially in response to rotation of the first collar, thereby changing a cross-sectional area of the volute by moving the plunger axially, selectively towards or away from the top plate, to adjust a flow of the fluid impelled by the impeller and out of the volute.

12. The centrifugal pump of claim 11, wherein the first collar is an outer collar and the second collar is an inner collar, and wherein the outer collar and inner collar are threadably engaged such that rotation of the outer collar causes the inner collar to move axially within the casing.

13. The centrifugal pump of claim 11, wherein the first collar is configured to rotate about a longitudinal axis of the pump, the longitudinal axis of the pump extending substantially centrally through the inlet of the volute and an impeller shaft of the impeller, and the second collar is configured to translate axially along the longitudinal axis of the pump.

14. The centrifugal pump of claim 11, wherein the first collar has a shape defined by an inner circumference and an outer circumference, the shape of the first collar being substantially concentric with a shape of the impeller, and wherein the second collar has a shape defined by an inner circumference and an outer circumference, the inner circumference of the second collar being substantially concentric with the shape of the impeller and the outer circumference of the second collar having a shape that is commensurate with a shape of an inner wall of the volute.

15. The centrifugal pump of claim 14, wherein the outer circumference of the second collar is a logarithmic spiral that substantially matches an expanding shape of the inner wall of the volute.

16. The centrifugal pump of claim 11, further comprising a controller configured to command selective movement of the first collar based on one or more parameters.

17. The centrifugal pump of claim 16, wherein the one or more parameters comprise at least one of a desired fluid flow rate for the fluid discharged from the volute, a desired fluid volume for the fluid discharged from the volute, a pressure of the fluid received via the inlet, a pressure change between the inlet and the outlet of the pump, a meridional distribution of static pressure in the volute, power consumed by the pump, a pump motor voltage, a pump motor current, impeller shaft torque, or impeller shaft speed.

18. A centrifugal pump, comprising:

a casing having a casing side wall, a baseplate, and a top plate having an inlet formed therein, the casing side wall, the baseplate and the top plate defining an interior cavity, and the interior cavity defining a volute therein;

an impeller disposed in the volute;

a first collar disposed in the interior cavity and in contact with the top plate;

a second collar disposed in the interior cavity, the second collar being movable within the interior cavity of the casing relative to the top plate of the casing; and an actuator disposed on a first axial side of the volute and configured to initiate adjustment of a cross-sectional area of the volute from only a single location along a circumference of the volute, the adjustment occurring by rotating the first collar to axially move the second collar selectively towards or away from the baseplate, thereby adjusting a flow of fluid impelled by the impeller and out of the volute, and wherein the casing seals off an entirety of the interior cavity from an outside environment at all positions of the second collar relative to the top plate.

19. The centrifugal pump of claim 18, wherein the first collar is an outer collar and the second collar is an inner collar, and wherein the outer collar and inner collar are threadably engaged such that rotation of the outer collar causes the inner collar to move axially within the casing.

20. The centrifugal pump of claim 18, wherein the first collar is configured to rotate about a longitudinal axis of the pump, the longitudinal axis of the pump extending substantially centrally through the inlet of the volute and an impeller shaft of the impeller, and the second collar is configured to translate axially along the longitudinal axis of the pump.

21. The centrifugal pump of claim 18, wherein the first collar has a shape defined by an inner circumference and an outer circumference, the shape of the first collar being substantially concentric with a shape of the impeller, and wherein the second collar has a shape defined by an inner circumference and an outer circumference, the inner circumference of the second collar being substantially concentric with the shape of the impeller and the outer circumference of the second collar having a shape that is commensurate with a shape of an inner wall of the volute.

22. The centrifugal pump of claim 21, wherein the outer circumference of the second collar is a logarithmic spiral that substantially matches an expanding shape of the inner wall of the volute.

23. The centrifugal pump of claim 18, further comprising a controller configured to command selective movement of the first collar based on one or more parameters.

24. The centrifugal pump of claim 23, wherein the one or more parameters comprise at least one of a desired fluid flow rate for the fluid discharged from the volute, a desired fluid volume for the fluid discharged from the volute, a pressure of the fluid received via the inlet, a pressure change between the inlet and the outlet of the pump, a meridional distribution of static pressure in the volute, power consumed by the pump, a pump motor voltage, a pump motor current, impeller shaft torque, or impeller shaft speed.

25. The centrifugal pump of claim 18, wherein the actuator is a worm drive.

* * * * *